US011794502B2

(12) United States Patent
Suzuki et al.

(10) Patent No.: US 11,794,502 B2
(45) Date of Patent: Oct. 24, 2023

(54) INK CASSETTE AND PRINTER

(71) Applicant: CANON KABUSHIKI KAISHA, Tokyo (JP)

(72) Inventors: Masaki Suzuki, Hokkaido (JP); Yukiteru Yano, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 70 days.

(21) Appl. No.: 17/158,816

(22) Filed: Jan. 26, 2021

(65) Prior Publication Data

US 2021/0237496 A1 Aug. 5, 2021

(30) Foreign Application Priority Data

Jan. 31, 2020 (JP) ..... 2020-015532
Jan. 31, 2020 (JP) ..... 2020-015604

(51) Int. Cl.
*B41J 32/00* (2006.01)

(52) U.S. Cl.
CPC ..... *B41J 32/00* (2013.01)

(58) Field of Classification Search
None
See application file for complete search history.

(56) References Cited

U.S. PATENT DOCUMENTS 5,110,228 A * 5/1992 Yokomizo ..... B41J 17/32 242/343.1
5,865,545 A 2/1999 Kondo
7,151,555 B2 * 12/2006 Kaida ..... B41J 17/32 347/214

(Continued)

FOREIGN PATENT DOCUMENTS

CN 1176182 A 3/1998
CN 101041305 A 9/2007

(Continued)

OTHER PUBLICATIONS

The above Foreign Patent Documents were cited in a Chinese Office Action dated Jun. 22, 2022, which is enclosed without translation, that issued in the corresponding Chinese Patent Application No. 202110096101.3.

(Continued)

*Primary Examiner* — Matthew G Marini
(74) *Attorney, Agent, or Firm* — Cowan, Liebowitz & Latman, P.C.

(57) ABSTRACT

An ink cassette comprises a supply bobbin, a winding bobbin, and an enclosure including a supply bobbin storage portion and a winding bobbin storage portion. In the supply bobbin storage portion and the winding bobbin storage portion, an opening is provided in one side surface of the enclosure, with an elastic piece provided within each of the openings, and a rotation restricting portion is provided on an inner side of another side surface of the enclosure. The supply bobbin and the winding bobbin has a rotation-restricted portion. The supply bobbin and the winding bobbin are biased by the elastic pieces toward the other side surface in which the rotation restricting portions are provided, and the rotation-restricted portions engage with the rotation restricting portions and restrict rotation of the supply bobbin and the winding bobbin.

26 Claims, 21 Drawing Sheets

(56) References Cited

U.S. PATENT DOCUMENTS

| | | | | |
|---|---|---|---|---|
| 7,808,518 | B2 | 10/2010 | Nakai | |
| 2005/0084310 | A1 | 4/2005 | Funaki et al. | |
| 2015/0062278 | A1 | 3/2015 | Suzuki | |
| 2019/0118554 | A1* | 4/2019 | Tanizaki | B41J 2/335 |

FOREIGN PATENT DOCUMENTS

| | | | | |
|---|---|---|---|---|
| CN | 104417104 | A | 3/2015 | |
| EP | 638434 | A2 * | 2/1995 | B41J 17/32 |
| EP | 1449672 | A1 | 8/2004 | |
| JP | H04-064160 | U | 6/1992 | |
| JP | H061027 | A | 1/1994 | |
| JP | 2001-205881 | A | 7/2001 | |
| JP | 2001260448 | A | 9/2001 | |
| JP | 2005047054 | A | 2/2005 | |
| JP | 2010-076186 | A | 4/2010 | |
| JP | 2015-051515 | A | 3/2015 | |
| JP | 2015-051518 | A | 3/2015 | |
| WO | 2014/084169 | A1 | 6/2014 | |

OTHER PUBLICATIONS

The above documents were cited in a European Partial Search Report dated Jul. 8, 2021, which is enclosed, that issued in the corresponding European Patent Application No. 21150190.3.

The above foreign patent documents were cited in the Sep. 1, 2023 Japanese Office Action, that issued in Japanese Patent Application No. 2020-015532.

The above Foreign Patent Document was cited in an Aug. 22, 2023 Japanese Office Action, that issued in Japanese Patent Application No. 2020-015604.

* cited by examiner

III-III CROSS SECTION

IV-IV CROSS SECTION

V-V CROSS SECTION

INK CASSETTE AND PRINTER

BACKGROUND OF THE INVENTION

Field of the Invention

The present invention relates to an ink cassette and a printer in which the ink cassette can be mounted.

Description of the Related Art

A dye sublimation printer prints images by using a thermal head and a platen roller to pressurize a recording medium such as sheet against an ink ribbon and then electrifying the thermal head, which causes a heating element on the thermal head to emit heat and cause dye on the ink ribbon to sublimate and transfer to the sheet.

The configuration is such that a cylindrical supply bobbin and a winding bobbin, on which the ink ribbon is wound, are contained within an ink cassette for making it easy to mount and remove the ink ribbon to and from the printer, and the supply bobbin and the winding bobbin are rotatably held within the ink cassette.

When the ink cassette is mounted in the printer, the thermal head is positioned between the supply bobbin and the winding bobbin, and an image is printed by driving the thermal head while the thermal head is pressed against the platen roller in a state where the ink ribbon and the sheet are overlaid.

External vibrations due to conveyance or the like may act on the ink cassette before the ink cassette is mounted and used in the printer. The vibrations acting on the ink cassette cause the ink ribbon wound on the supply bobbin and the winding bobbin to slacken, and the ink ribbon is pulled out from inside the ink cassette. It is therefore necessary to ensure that the supply bobbin and the winding bobbin in the ink cassette do not rotate w % ben the ink cassette is not mounted in the main body of the printer.

Japanese Patent Laid-Open No. 2001-205881 discloses an ink cassette that restricts the rotation of a supply bobbin and a winding bobbin by causing recess portions provided in end faces of the supply bobbin and the winding bobbin to engage with projection portions provided on an inner wall of the ink cassette. In Japanese Patent Laid-Open No. 2001-205881, the rotation of the bobbins is restricted by using mold pieces provided within the ink cassette to bias the supply bobbin and the winding bobbin in the axial directions to cause the recess portions of the supply bobbin and the winding bobbin to engage with the projection portions on the inner wall of the ink cassette. During use, the rotation restrictions on the supply bobbin and the winding bobbin are released by pressing the supply bobbin and the winding bobbin in the axial direction.

According to Japanese Patent Laid-Open No. 2015-051515, an ink cassette can be mounted in the direction of the rotational axis of a supply bobbin around which an ink ribbon is wound, parallel to a linear thermal element of a thermal head. This method is often used in smaller printers.

However, with the conventional technique disclosed in Japanese Patent Laid-Open No. 2001-205881, the mold pieces are provided within the ink cassette, which makes it necessary to provide spaces specifically for the mold pieces, and increases the length of the ink cassette in the direction of the rotational axis of the ink ribbon. Furthermore, the length of the mold pieces cannot be made longer than the winding diameter of the ink ribbon wound upon the supply bobbin and the winding bobbin. There is thus a problem in that stress produced in the mold pieces increases, and the supply bobbin and the winding bobbin cannot be biased with an appropriate force. In addition, although it is necessary to increase the length of the mold pieces to reduce the stress produced in the mold pieces, doing so increases the size of the ink cassette.

The present invention has been made in consideration of the aforementioned problems, and realizes an ink cassette and printer capable of restricting slackening of an ink ribbon by biasing a supply bobbin and a winding bobbin at an appropriate biasing force while keeping the size of the ink cassette small.

Additionally, in Japanese Patent Laid-Open No. 2015-051515, an ink cassette is configured including a supply bobbin storage portion that stores an ink ribbon and a winding bobbin storage portion into which the ink ribbon is taken up, where end parts of the near side and the far side of the storage portions in the direction in which the ink cassette is mounted in the printer are connected by connecting portions. Here, it is not necessary for the connecting portion on the near side in the mounting direction to be inserted into the printer, which makes it possible to secure a comparatively broad surface area and make a firm connection. On the other hand, the connecting portion on the far side in the mounting direction is configured not to interfere with the thermal head, the platen roller, and so on during mounting in the printer, which limits the shape, surface area, and so on of the connecting portion and makes it more difficult to make a firm connection than with the connecting portion on the near side in the mounting direction. Although it is possible to make a firmer connection by increasing the size of the connecting portion on the far side in the mounting direction, doing so increases the size of the ink cassette.

The present invention has been made in consideration of the aforementioned problems, and realizes an ink cassette and a printer which can achieve a smaller size while ensuring the strength of the ink cassette.

SUMMARY OF THE INVENTION

In order to solve the aforementioned problems, the present invention provides an ink cassette comprising: a supply bobbin on which an ink ribbon is wound; a winding bobbin for winding up the ink ribbon fed from the supply bobbin; and an enclosure including a supply bobbin storage portion that rotatably stores the supply bobbin and a winding bobbin storage portion that rotatably stores the winding bobbin, wherein in each of the supply bobbin storage portion and the winding bobbin storage portion, an opening is provided in one side surface of the enclosure, with an elastic piece provided within each of the openings, and a rotation restricting portion is provided on an inner side of another side surface of the enclosure, the supply bobbin and the winding bobbin are capable of moving in a rotational axis direction, and each has a rotation-restricted portion, and the supply bobbin and the winding bobbin are each biased by the elastic pieces toward the other side surface in which the rotation restricting portions are provided, and the rotation-restricted portions engage with the rotation restricting portions and restrict rotation of the supply bobbin and the winding bobbin.

In order to solve the aforementioned problems, the present invention provides a printer in which an ink cassette can be mounted and removed, the ink cassette comprising: a supply bobbin on which an ink ribbon is wound; a winding bobbin for winding up the ink ribbon fed from the supply bobbin; and an enclosure including a supply bobbin storage portion that rotatably stores the supply bobbin and a winding bobbin storage portion that rotatably stores the winding bobbin, wherein in each of the supply bobbin storage portion and the winding bobbin storage portion, an opening is provided in one side surface of the enclosure, with an elastic piece provided within each of the openings, and a rotation restricting portion is provided on an inner side of another side surface of the enclosure, the supply bobbin and the winding bobbin are capable of moving in a rotational axis direction, and each has a rotation-restricted portion, and the supply bobbin and the winding bobbin are each biased by the elastic pieces toward the other side surface in which the rotation restricting portions are provided, and the rotation-restricted portions engage with the rotation restricting portions and restrict rotation of the supply bobbin and the winding bobbin, the printer comprising: a member configured to, when the ink cassette is mounted, cause the rotation-restricted portions to disengage from the rotation restricting portions by moving the supply bobbin and the winding bobbin toward the one side surface of the enclosure in which the elastic pieces are provided.

In order to solve the aforementioned problems, the present invention provides an ink cassette comprising a supply bobbin storage portion configured to support a supply bobbin on which an ink sheet to which ink is applied is wound, a winding bobbin storage portion configured to support a winding bobbin that winds up the ink sheet pulled out from the supply bobbin, and a connecting portion that connects the supply bobbin storage portion and the winding bobbin storage portion, the ink cassette capable of being mounted in a printer using an axial direction of the supply bobbin and the winding bobbin as a mounting direction, w % herein the connecting portion includes a first connecting portion that connects a near side of the supply bobbin storage portion and the winding bobbin storage portion with respect to the mounting direction, and a second connecting portion that connects a far side of the supply bobbin storage portion and the winding bobbin storage portion with respect to the mounting direction, and the second connecting portion projects further toward the far side in the mounting direction than the supply bobbin storage portion and the winding bobbin storage portion, and the supply bobbin and the winding bobbin.

According to the present invention, an ink cassette and printer capable of restricting slackening of an ink ribbon by biasing a supply bobbin and a winding bobbin at an appropriate biasing force w % bile keeping the size of the ink cassette small can be realized.

According to the present invention, an ink cassette and a printer capable of increasing the strength of a connecting portion on a far side in a mounting direction of the ink cassette, while at the same time reducing the size of the printer, can be realized.

Further features of the present invention will become apparent from the following description of exemplary embodiments (with reference to the attached drawings).

DESCRIPTION OF THE EMBODIMENTS

Figure 1A:
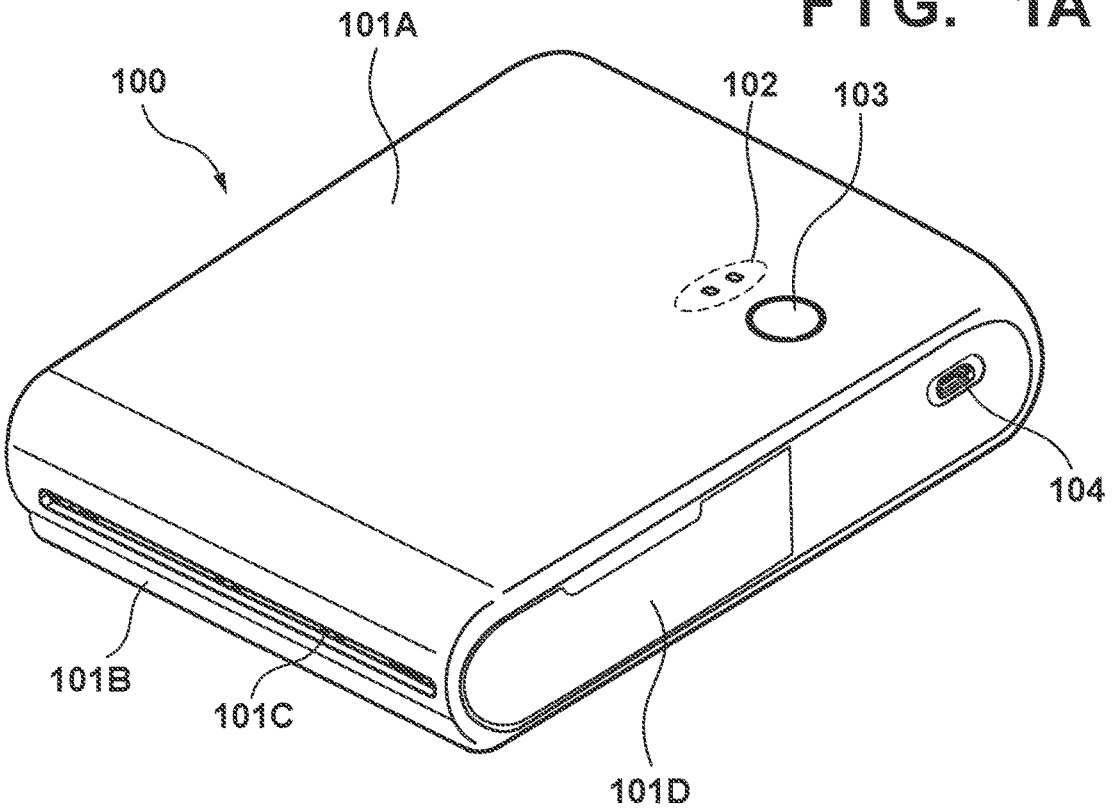
FIGS. 1A and 1B are perspective views illustrating the external configuration of a printer 100 according to an embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

An example in which the present invention is applied in a thermal printer that uses thermal transfer or dye sublimation will be described hereinafter. However, the present invention is not limited to a thermal printer or an ink cassette, and can be applied in other types of printers and ink cassettes as well.

Additionally, the present invention is not limited to a printer alone, and can be applied in any device having a printing function, such as a copier, a facsimile device, a computer system, or the like. "Recording sheet" according to the present invention includes not only paper material, but also sheet materials made from other types of material, such as plastic film or the like.

In a thermal printer, an ink ribbon to which ink is applied (an ink sheet) and recording sheet are pressurized by a thermal head (a print head) and a platen roller (a receiving member), and printing is performed by conveying the ink ribbon and the recording sheet (print sheet) in a state of contact with the thermal head. A plurality of thermal elements (resistance elements) are disposed in a line shape in the thermal head, and an image is printed onto the recording sheet by selectively electrifying the heating elements so as to transfer the ink from the ink ribbon onto the recording sheet. In particular, when printing in full color, yellow (Y), magenta (M), and cyan (C) inks, which are applied to the ink ribbon in order, are superimposed on each other in that order to form a full-color image, and an overcoat (OP) is also transferred onto the image.

In the following descriptions, "printing" is assumed to refer to an overall series of operations, from printing on the basis of a printing instruction from a user, to discharging recording sheet onto which an image has been printed. An "image being printed" is assumed to refer to an operation, among the printing operations, of forming an image on the recording medium by thermally transferring ink from the ink ribbon onto the recording sheet. Note that with monochromatic printing, the recording sheet may be in the form of a roll, and may be discharged after being cut to a predetermined size after an image is printed.

Apparatus Configuration

The overall configuration of a thermal printer according to the present embodiment will be described with reference to FIGS. 1A, 1B, 2A, and 2B.

Figure 1B:
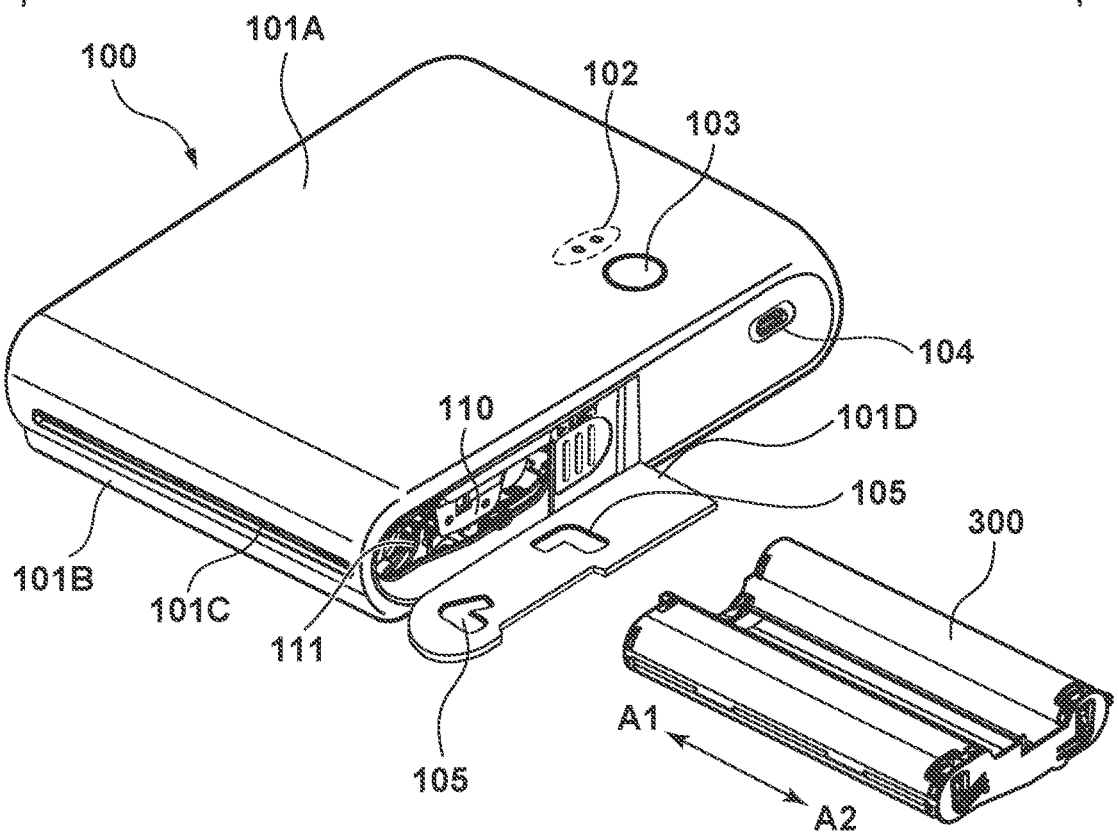
Figure 2A:
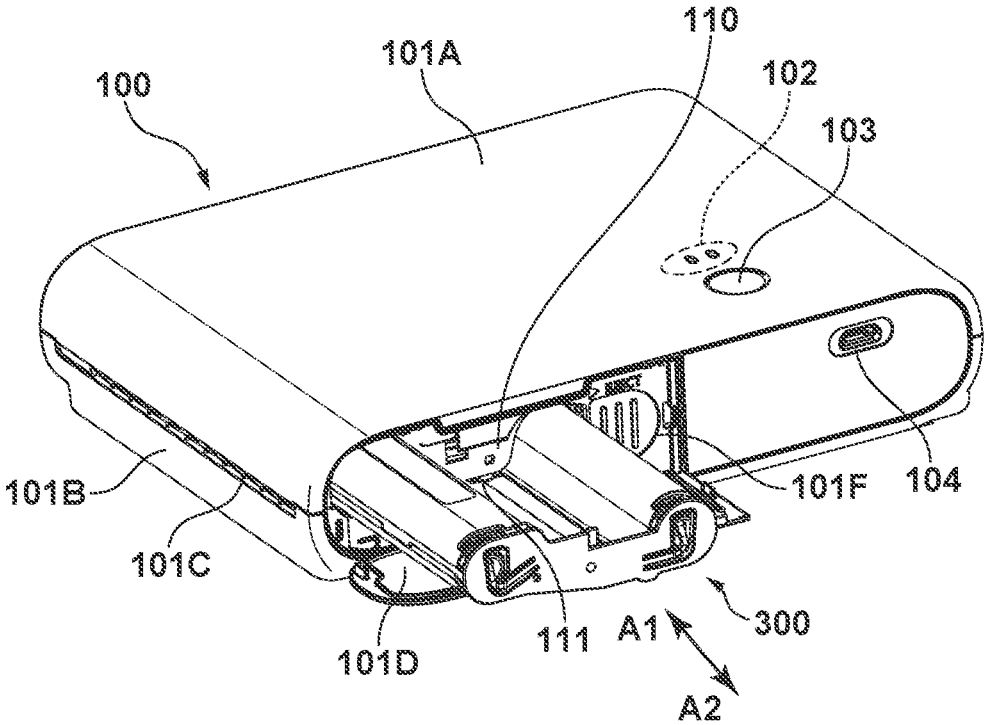
FIG. 2A is a perspective view of the external configuration of the printer 100 and an ink cassette 300 according to an embodiment, seen from above.
Figure 2B:
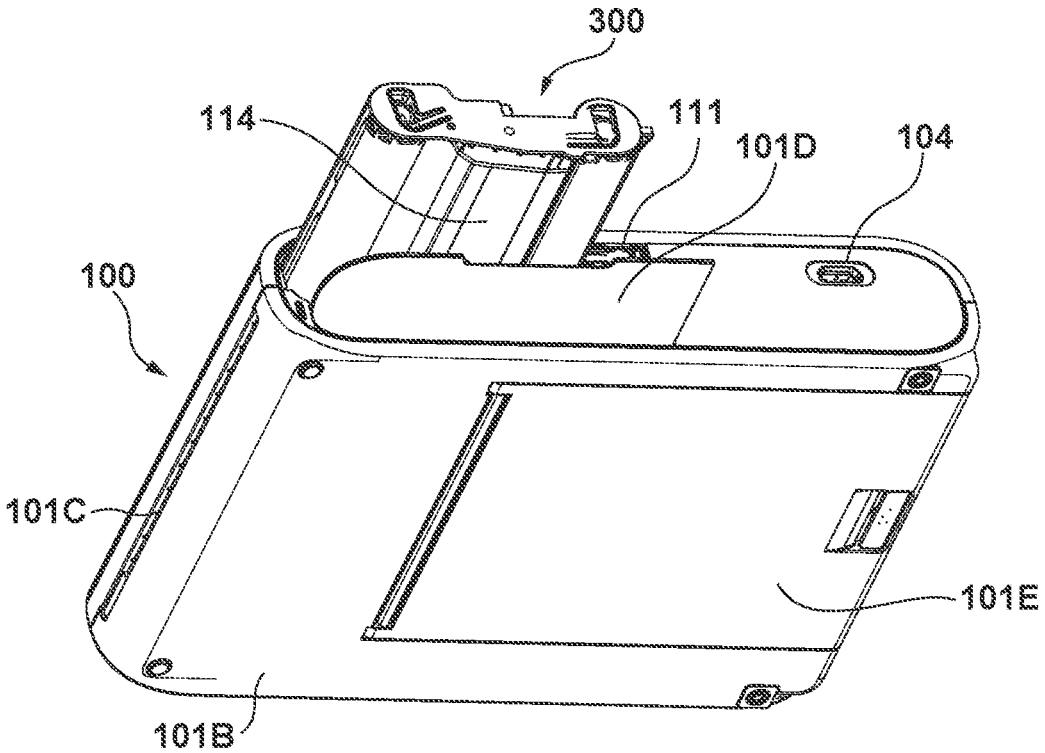
FIG. 2B is a perspective view of the external configuration of the printer 100 and the ink cassette 300 according to an embodiment, seen from below.

FIG. 1A is a perspective view illustrating the external configuration of a printer 100 according to the present embodiment. FIG. 1B is a perspective view of the external configuration of the printer 100 and an ink cassette 300. FIG. 2A is a perspective view of the external configuration of the printer 100 and the ink cassette 300 according to the present embodiment, seen from above. FIG. 2B is a perspective view of the external configuration of the printer 100 and the ink cassette 300 according to the present embodiment, seen from below.

The printer 100 includes an upper case 101A and a lower case 101B as exterior members which cover upper and lower sides of a main body of the printer. A slit-shaped gap, which forms an opening that serves as a discharge port 101C, is formed in one side surface of the printer 100, in a surface where the upper case 101A and the lowercase 101B come together. During printing, recording sheet 113 temporarily protrudes from the discharge port 101C to the exterior of the printer 100, recording sheet 113 for which printing is finished is discharged from the discharge port 101C, and so on. Note that the recording sheet 113 is not shown in FIGS. 1A to 2B.

A cassette cover 101D, which is capable of opening and closing, is provided on another side surface of the printer 10. The cassette cover 101D is capable of opening and closing a cassette mounting portion 111, which is an opening provided in a chassis 110. The ink cassette 300 can be inserted into and removed from the printer 100 through the cassette mounting portion 111. The ink cassette 300 can be mounted, in the direction of an arrow A1, in the cassette mounting portion 111 within the printer 100 from the cassette mounting portion 111, when the cassette cover 101D is open, and can be removed to the exterior of the printer 100 in the direction of an arrow A2, which is opposite from the arrow A1. A cassette lever 101F is manipulated in order to hold the ink cassette 300 inside the printer 100, and when removing the ink cassette 300 from the printer 100. Two rectangular recess portions 105 are formed on side surfaces of the cassette cover 101D located on the inner side of the printer.

The ink cassette 300 contains a long ink ribbon 114, which is conveyed by power received from the printer 100 during printing. The ink cassette 300 will be described in detail later.

A tray cover 101E, which can be opened and closed, is provided on a bottom surface of the printer 100, and by opening the tray cover 101E, a specified number of sheets of the recording sheet 113 can be loaded into a sheet storage unit 117, which will be described later. A user loads the recording sheet 113 of a specified size into the sheet storage unit 117, and during printing, one sheet is pulled out from the sheet storage unit 117 by a sheet feed mechanism (not shown) of the printer 100. A full-color image is printed by using a thermal head 116 to transfer yellow (Y), magenta (M), and cyan (C) color inks (described later with reference to FIG. 19) applied to the ink ribbon 114, as well as an overcoat (OP), onto the recording sheet 113.

A display unit 102 and an operating unit 103 are provided in an upper surface of the upper case 101A. Additionally, an external connection terminal 104 is provided in a side surface of the printer 100, which enables an external device, such as a digital camera or smartphone, to be connected using a USB cable or the like. A wireless communication unit is provided within the printer 100, which enables an external device, such as a digital camera or smartphone, to be connected through wireless LAN or the like. The printer 100 is capable of receiving image data from a host device connected through the external connection terminal 104, the wireless communication unit, or the like, and printing the image data.

The display unit 102 includes a plurality of light-emitting elements such as LEDs, and displays an operating state of the printer 100 through colored light, lighting up, flashing, or the like. The operating unit 103 receives operating instructions such as turning the printer 100 on and off. Upon receiving a printing instruction in which a desired image is selected from the host device while the power is on, the printer 100 starts printing according to the printing instruction.

Configuration of Ink Cassette

The configuration of the ink cassette 300 will be described in detail next with reference to FIGS. 3A to 11D.

Figure 3A:
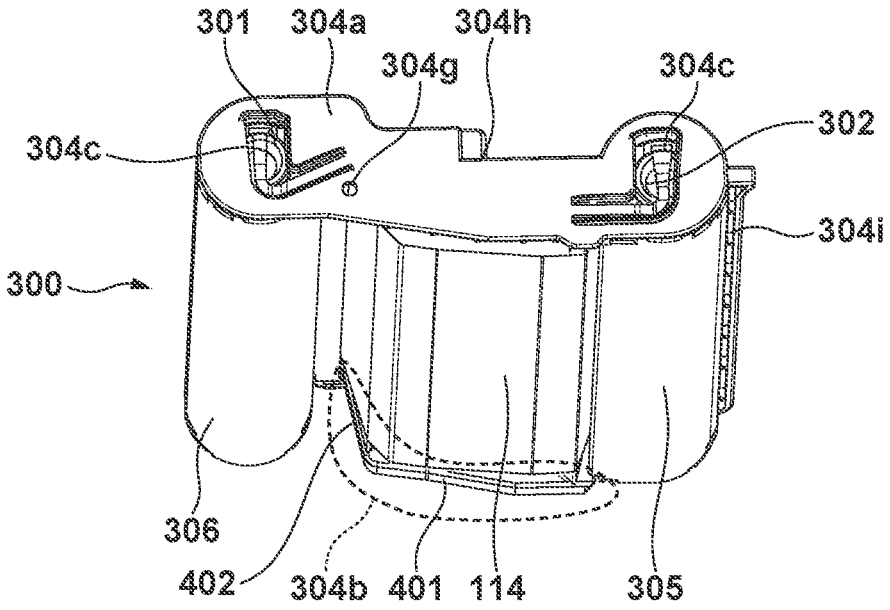
FIG. 3A is a perspective view illustrating an end part on a near side in a mounting direction of the ink cassette 300, according to an embodiment, seen from below.
Figure 3B:
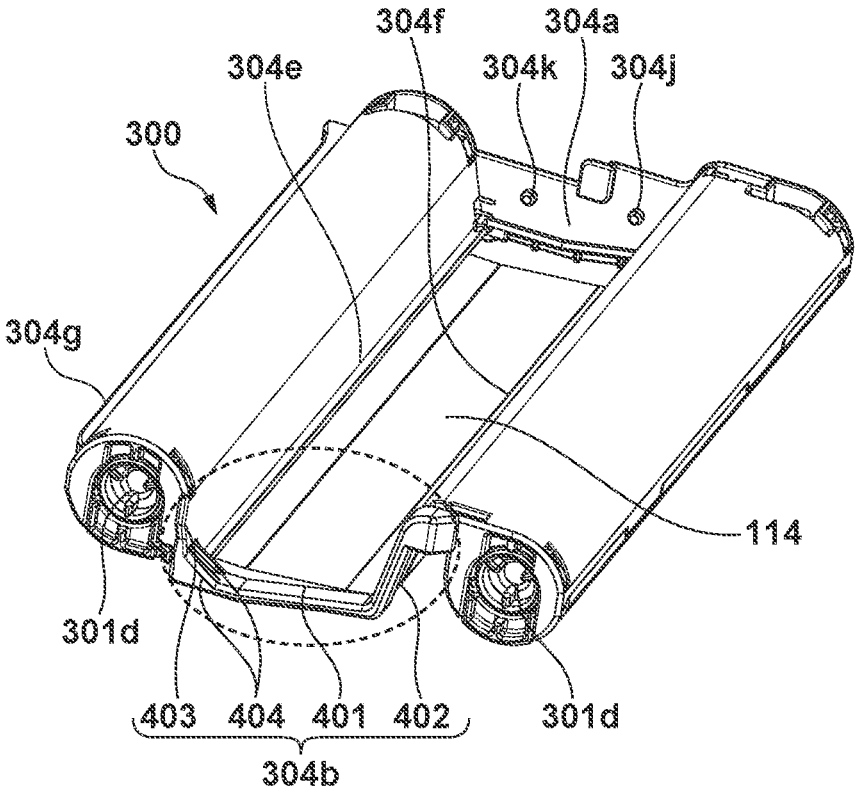
FIG. 3B is a perspective view illustrating an end part on a far side in a mounting direction of the ink cassette 300, according to an embodiment, seen from above.
Figure 4:
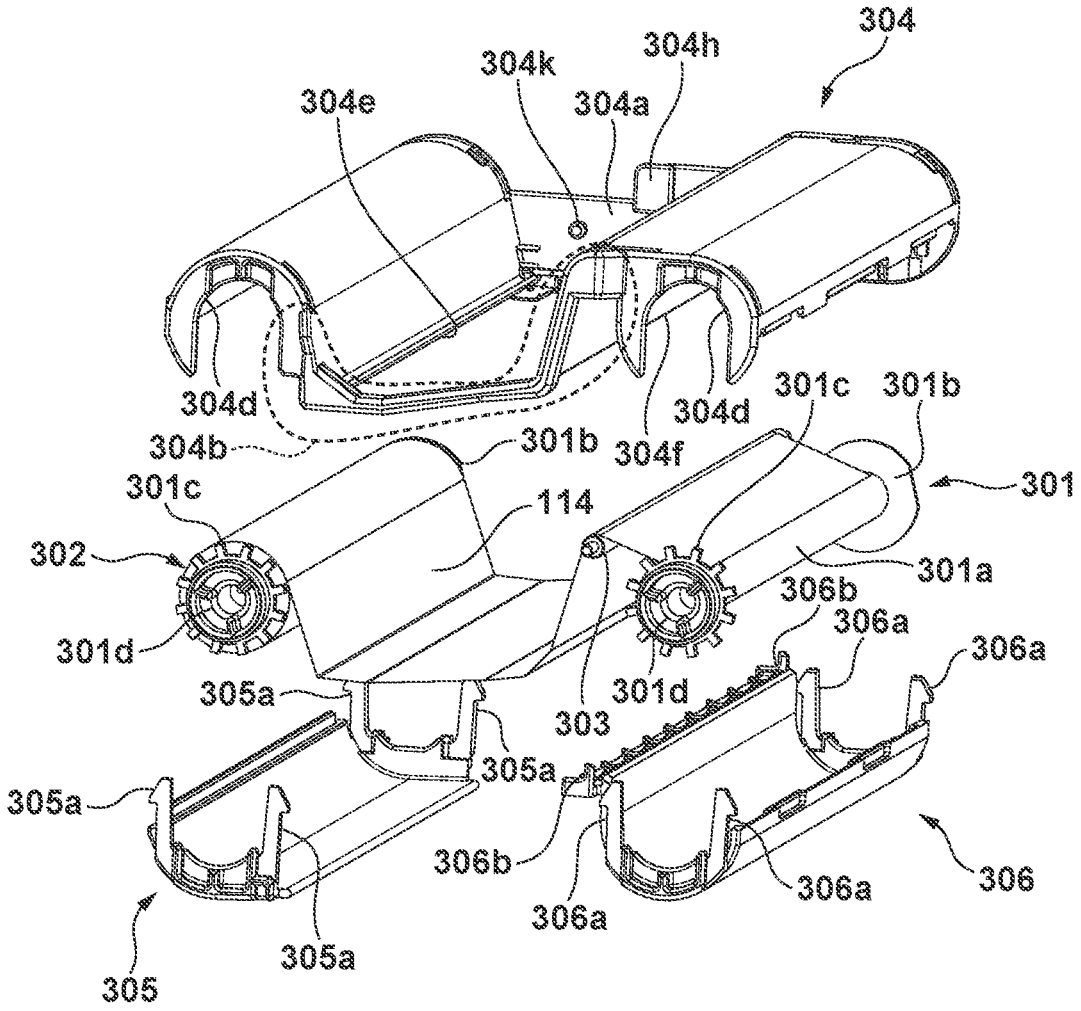
FIG. 4 is an exploded perspective view of the ink cassette 300.
Figure 5:
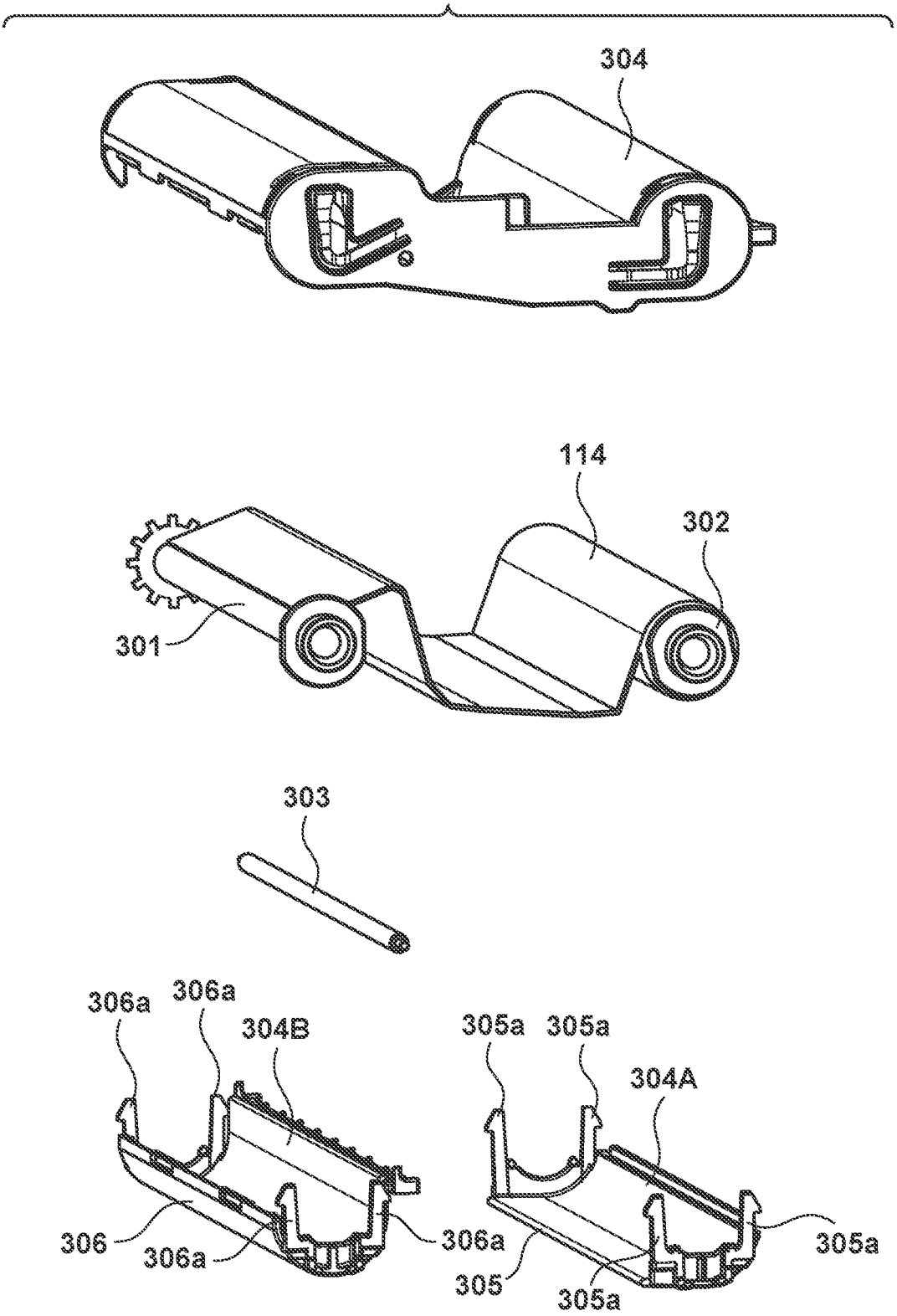
FIG. 5 is an exploded perspective view of the ink cassette 300 seen from the opposite direction to that illustrated in FIG. 4.
Figure 6A:
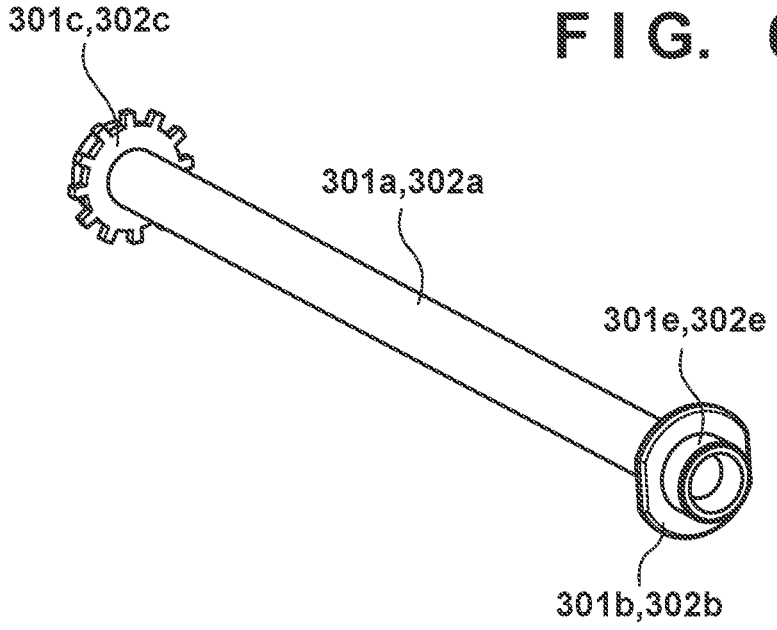
FIG. 6A is a perspective view of a supply bobbin 302 and a winding bobbin 301, seen from the near side in the mounting direction.
Figure 6B:
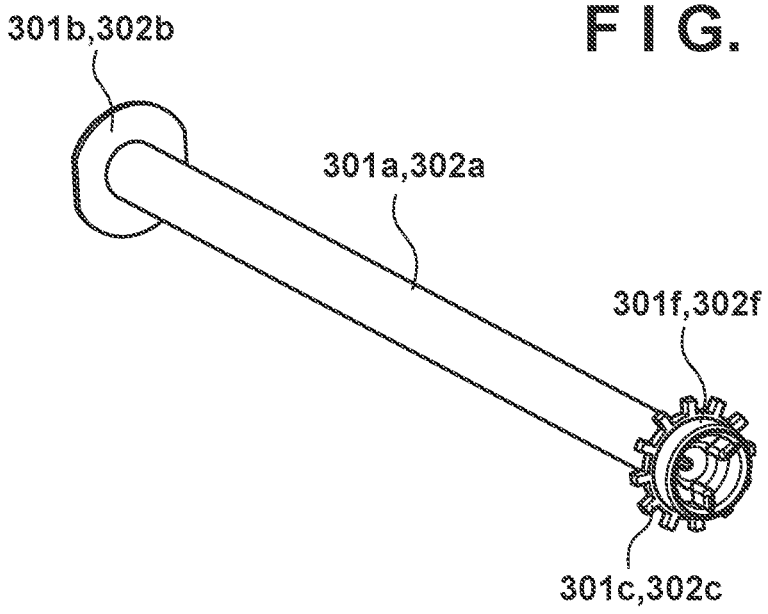
FIG. 6B is a perspective view of the supply bobbin 302 and the winding bobbin 301, seen from the far side in the mounting direction.

FIG. 3A is a perspective view illustrating an end part on a near side in a mounting direction of the ink cassette 300, according to the present embodiment, seen from below. FIG. 3B is a perspective view illustrating an end part on a far side in the mounting direction of the ink cassette 3M), according to the present embodiment, seen from above. FIG. 4 is an exploded perspective view of the ink cassette 300. FIG. 5 is an exploded perspective view of the ink cassette 300 seen from the opposite direction to that illustrated in FIG. 4. FIGS. 6A and 6B are perspective views illustrating the external configurations of a supply bobbin 302 and a winding bobbin 301.

As illustrated in FIG. 4, the ink ribbon 114 is contained within a cassette case 304, wound upon the supply bobbin 302 and with another end attached to the winding bobbin 301. The cassette case 304 is manufactured by injection-molding a high-strength engineering plastic such as ABS or PC to ensure sliding performance with respect to the ink ribbon 114, conveyance performance, and so on.

The cassette case 304 has a configuration in which both end parts of two semicylinders are connected by a mounting direction near-side connecting portion 304*a* and a mounting direction far-side connecting portion 304*b*, and open portions of the two semicylinders are covered by a supply bobbin cover 305 and a winding bobbin cover 306, with the two semicylinders disposed parallel to each other. The supply bobbin cover 305 and the winding bobbin cover 306 are integrated by having supply bobbin-side engagement claws 305*a* and winding bobbin-side engagement claws 306*a*, four each of which are provided near both end parts of those covers, engage with engagement holes provided in the cassette case 304. Like the cassette case 304, the supply bobbin cover 305 and the winding bobbin cover 306 are injection-molded components.

The supply bobbin cover 305 includes a supply bobbin storage portion 304A which contains the supply bobbin 302. The winding bobbin cover 306 includes a winding bobbin storage portion 304B which contains the winding bobbin 301. The supply bobbin 302 and the winding bobbin 301 are rotatably contained within the supply bobbin storage portion 304A and the winding bobbin storage portion 304B, respectively. Additionally, the supply bobbin 302 and the winding bobbin 301 are contained within the supply bobbin storage portion 304A and the winding bobbin storage portion 304B, respectively, so as to be capable of moving in a rotational axis direction.

The supply bobbin 302 and the winding bobbin 301 are rotatably supported within substantially cylindrical enclosures constituted by the cassette case 304 and the supply bobbin cover 305 or the winding bobbin cover 306. The ink ribbon 114 is pulled out from an end part of a supply bobbin-side guide wall 304*e* and is guided to an end part of a winding bobbin-side guide wall 304*f* through an opening provided between the supply bobbin cover 305 and winding bobbin cover 306, and the cassette case 304. Furthermore, the ink ribbon 114, which has bent at the end part of the winding bobbin-side guide wall 304*f*, is conveyed along the winding bobbin-side guide wall 304*f*, and is further bent by a guide shaft 303 rotatably supported at an upper portion and connected to the winding bobbin 301. In this manner, the guide shaft 303 bends a conveyance path of the ink sheet, which has been conveyed along the winding bobbin-side guide wall 304*f*, toward the winding bobbin within the winding bobbin storage portion 304B. The guide shaft 303 is an injection-molded component made of a highly-slidable resin material such as ABS or PS, and includes a large-diameter part that makes contact with the ink ribbon 114, and small-diameter parts which are located at both end parts of the large-diameter part and slide against a guide bearing portion 306*b* of the winding bobbin cover 306.

The winding bobbin 301 and the supply bobbin 302 have the same shape, and are injection-molded components made using a high-strength resin material such as ABS or PS. Because the winding bobbin 301 and the supply bobbin 302 have the same shape, the same reference signs will be used to describe the detailed configurations thereof. In both the winding bobbin 301 and the supply bobbin 302, a flange 301*b* is provided near a tip portion of a cylindrical shaft portion 301*a*, and a latched flange 301*c* is provided at the other end, the latched flange 301*c* having a plurality of projecting shapes provided in a circumferential direction and concentrically with the cylindrical shaft portion 301*a*. A ribbon shaft pressing portion 304*c*, which is capable of elastic deformation, is provided integrally with a surface on the near side of the cassette case 304 in the mounting direction. The ribbon shaft pressing portion 304*c* is provided so as to make contact with end faces of the winding bobbin 301 and the supply bobbin 302. When the ink cassette 300 is not mounted in the printer 100, the ribbon shaft pressing portion 304*c* presses the winding bobbin 301 and the supply bobbin 302 toward the far side in the mounting direction. At this time, a gap between the plurality of the projecting shapes provided in the latched flange 301*c* in the circumferential direction thereof fits around a projecting portion (not shown) provided on an inner side of a side wall which forms a mounting surface-side bearing portion 304*d*. As a result, when the ink cassette 300 is not mounted in the printer 100, the rotation of the winding bobbin 301 and the supply bobbin 302 is restricted, which prevents the ink ribbon 114 from slackening. A bobbin engagement portion 301*d* is provided in an end face of both the winding bobbin 301 and the supply bobbin 302, on the far side in the mounting direction. Each bobbin engagement portion 301*d* enters into a corresponding one of a winding bobbin support portion 130 and a supply bobbin support portion 131 of the printer 100, and synchronized rotation can be performed by rib portions provided in a radial pattern at three locations engaging with the projecting portions of the respective bobbins.

As illustrated in FIGS. 6A and 6B, the supply bobbin 302 and the winding bobbin 301 include: cylindrical rotational shafts 302*a* and 301*a*, provided in a central part; first shaft end parts 302*e* and 301*e*, provided on the near side in the mounting direction; and second shaft end parts 302*f* and 301*f*, provided on the far side in the mounting direction. Flanges 302*b* and 301*b* are provided at boundary parts between the first shaft end parts 302*e* and 301*e* and the rotational shafts 302*a* and 301*a*. Rotation-restricted portions 302*c* and 301*c* are provided at boundary parts between the second shaft end parts 302*f* and 301*f* and the rotational shafts 302*a* and 301*a*. The rotation-restricted portions 302*c* and 301*c* are latched flanges in which a plurality of projecting shapes are provided on an outer side in a circumferential direction. As illustrated in FIG. 5, the ink ribbon 114 is wound between the flange 302*b* and the rotation-restricted portion 302*c* of the rotational shaft 302*a*. The supply bobbin 302 and the winding bobbin 301 rotate with the rotational shaft 302*a* and the rotational shaft 301*a* serving as respective rotational centers.

Figure 7A:
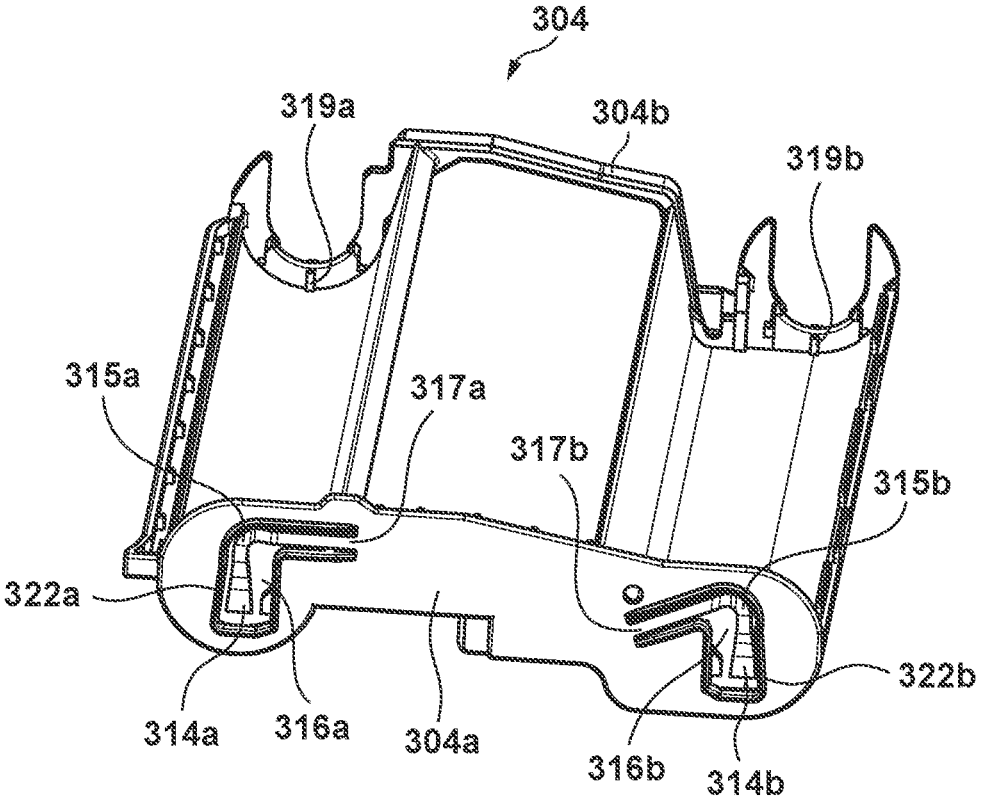
FIG. 7A is a perspective view of a cassette case 304, in a vertically-inverted state, seen from the near side in the mounting direction.
Figure 7B:
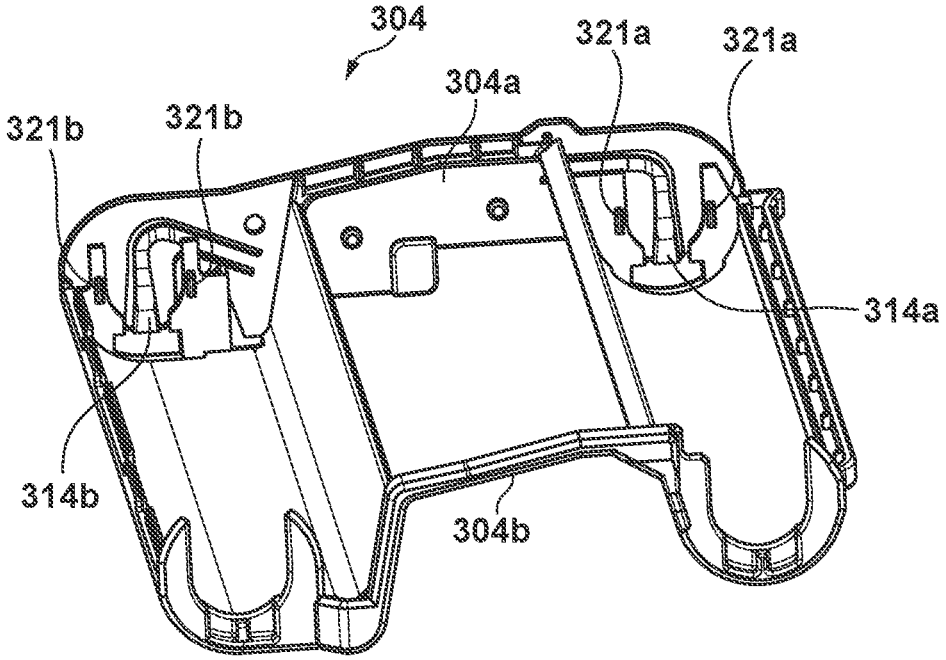
FIG. 7B is a perspective view of the cassette case 304, in a vertically-inverted state, seen from the far side in the mounting direction.
Figure 8A:
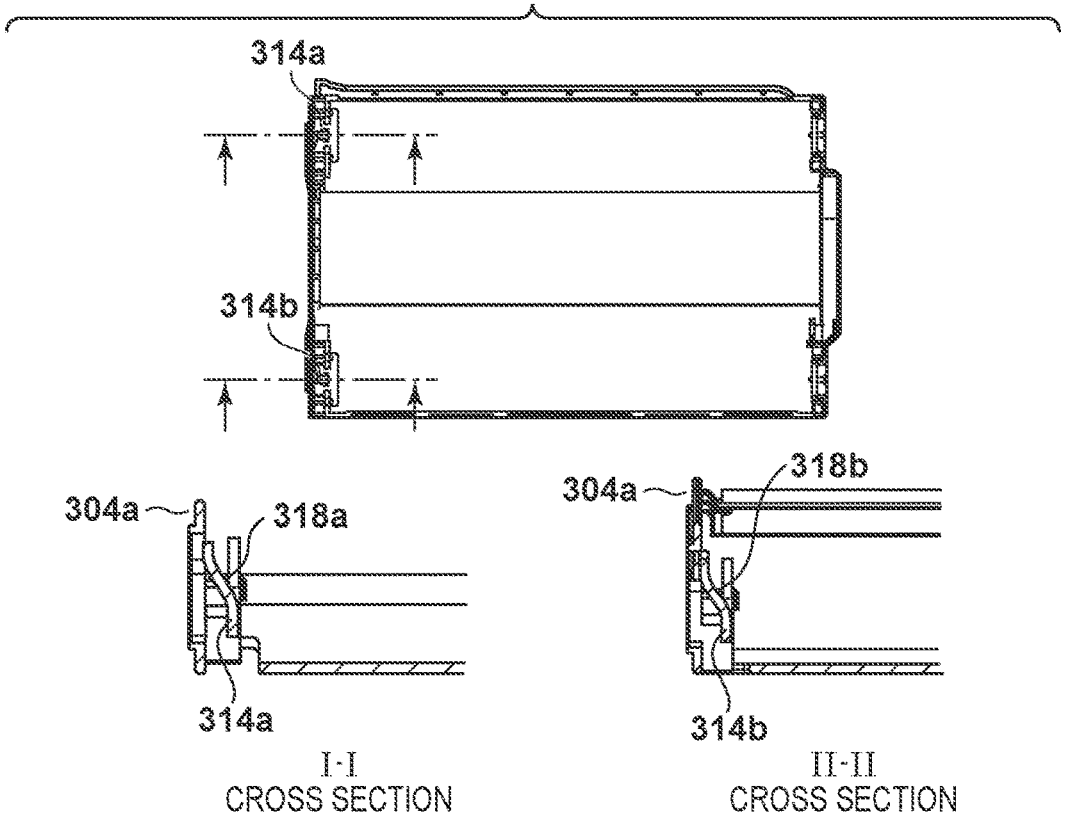
FIGS. 8A and 8B are diagrams illustrating operations of the supply bobbin 302 and the winding bobbin 301 incorporated into the cassette case 304.
Figure 8B:
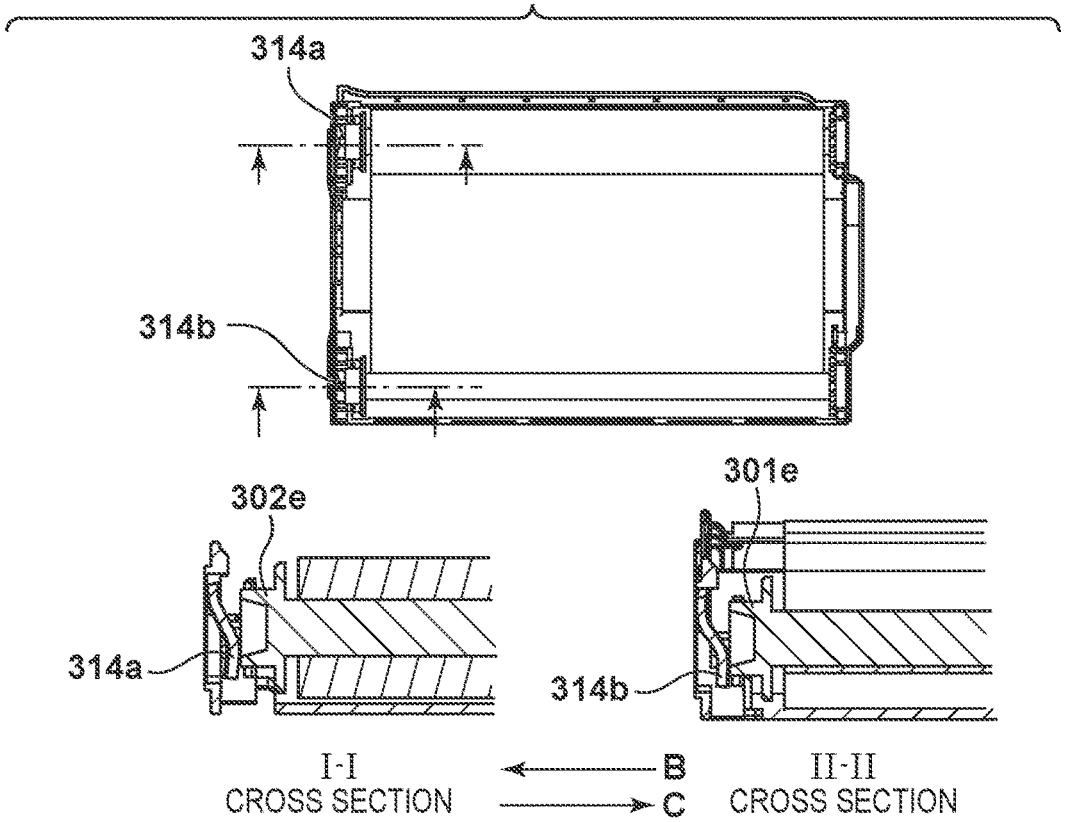
Figure 9:
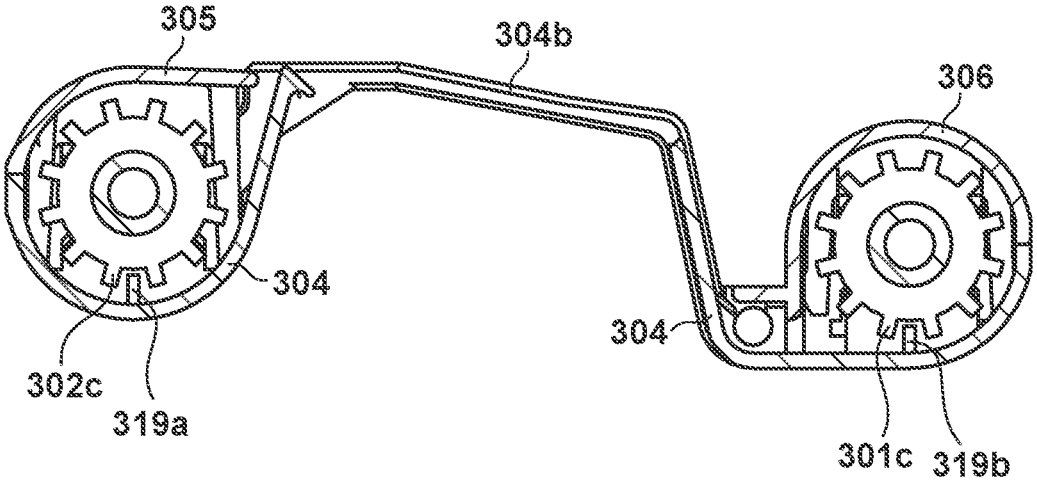
FIG. 9 is a cross-sectional side view of a far side of the ink cassette 300 in the mounting direction.

FIG. 7A is a perspective view of the cassette case 304, in a vertically-inverted state, seen from the near side in the mounting direction. FIG. 7B is a perspective view of the cassette case 304, in a vertically-inverted state, seen from the far side in the mounting direction. FIGS. 8A and 8B are diagrams illustrating operations of the supply bobbin 302 and the winding bobbin 301 incorporated into the cassette case 304. FIG. 9 is a cross-sectional side view of the far side of the ink cassette 300 in the mounting direction.

As illustrated in FIG. 7A, the cassette case 304 has elastic pieces 314*a* and 314*b* in the mounting direction near-side connecting portion 304*a*. The elastic piece 314*a* is configured to connect integrally with the mounting direction near-side connecting portion 304*a* at a base portion 317*a*, and an opening 316*a* is formed in the periphery of the elastic piece 314*a*. In other words, the elastic piece 314*a* is provided within the opening 316*a*. A projection portion 322*a*, which projects outward from the mounting direction near-side connecting portion 304*a*, is provided in the periphery of the opening 316*a*, and a width of the opening 316*a* is no greater than 10 mm. This makes it possible to prevent a finger from entering into the opening 316*a* and directly pressing the elastic piece 314*a* when touched by the finger from the mounting direction near-side connecting portion 304*a* side. The elastic piece 314*a* has a bent portion 315*a*. The bent portion 315*a* is bent within a plane of the mounting direction near-side connecting portion 304*a*, i.e., a plane that is substantially orthogonal to the rotational shafts 302*a* and 301*a* of the supply bobbin 302 and the winding bobbin 301. In other words, at the bent portion 315*a*, the elastic piece 314*a* bends in a direction that is substantially orthogonal to the rotational shafts 302*a* and 301*a*. Bending the elastic piece 314*a* in this manner makes it possible to lengthen the elastic piece 314*a*. Although the bent portion 315*a* is bent approximately 90 degrees in the present embodiment, the angle may be different. However, bending the elastic piece 314*a* by at least 90 degrees makes it possible to lengthen the elastic piece 314*a* even more. Note that a width of a tip of the elastic piece 314*a* is greater than widths of the bent portion 315*a* and the base portion 317*a*. In the same manner, the elastic piece 314*b* is configured to connect integrally with the mounting direction near-side connecting portion 304*a* at a base portion 317*b*, and an opening 316*b* is formed in the periphery of the elastic piece 314*b*. In other words, the elastic piece 314*b* is provided within the opening 316*b*. A projection portion 322*b*, which projects outward from the mounting direction near-side connecting portion 304*a*, is provided in the periphery of the opening 316*b*, and a width of the opening 316*b* is no greater than 10 mm. This makes it possible to prevent a finger from entering into the opening 316*b* and directly pressing the elastic piece 314*b* when touched by the finger from the mounting direction near-side connecting portion 304*a* side. The elastic piece 314*b* has a bent portion 315*b*. The bent portion 315*b* is bent within a plane of the mounting direction near-side connecting portion 304*a*, i.e., a plane that is substantially orthogonal to the rotational shafts 302*a* and 301*a* of the supply bobbin 302 and the winding bobbin 301. In other words, at the bent portion 315*b*, the elastic piece 314*b* bends in a direction that is substantially orthogonal to the rotational shafts 302*a* and 301*a*. Bending the elastic piece 314*b* in this manner makes it possible to lengthen the elastic piece 314*b*. Although the bent portion 315*b* is bent approximately 110 degrees in the present embodiment, the angle may be different. However, bending the elastic piece 314*b* by at least 90 degrees makes it possible to lengthen the elastic piece 314*b* even more. Note that a width of a tip of the elastic piece 314*b* is greater than widths of the bent portion 315*b* and the base portion 317*b*.

The ink cassette 300 according to the present embodiment is extremely compact, with an outer dimension, at the supply bobbin storage portion 304A and the winding bobbin storage portion 304B, of approximately 12 mm in a direction orthogonal to the rotational shafts 302*a* and 301*a*. This makes it difficult to ensure a sufficient length for the elastic piece 314*a*. Accordingly, providing the bent portions 315*a* and 315*b* makes it possible to make the elastic pieces 314*a* and 314*b* approximately 15 to 20 mm long, which ensures a sufficient length. When the outer dimension, at the supply bobbin storage portion 304A and the winding bobbin storage portion 304B, is no greater than 20 mm in the direction orthogonal to the rotational shafts 302*a* and 301*a*, it is desirable to form the elastic pieces at a sufficient length having provided such bent portions.

Operations of the supply bobbin 302 and the winding bobbin 301 incorporated into the cassette case 304 will be described next with reference to FIGS. 8A and 8B.

As illustrated in FIG. 8A, the elastic piece 314*a* and the elastic piece 314*b* have an inclined surface 318*a* and an inclined surface 318*b*, respectively, which are inclined from the mounting direction near-side connecting portion 304*a* toward the inner sides of the supply bobbin storage portion 304A and the winding bobbin storage portion 304B (the far side in the mounting direction). In other words, the elastic piece 314*a* and the elastic piece 314*b* are configured so as to be inclined toward the rotational shafts 302*a* and 301*a*.

The supply bobbin 302 can be incorporated into the cassette case 304 from above in the state illustrated in FIGS. 7A and 7B. The supply bobbin 302 is incorporated by pushing the inclined surface 318*a* in the direction of arrow B with the first shaft end part 302*e* of the supply bobbin 302. Accordingly, although the elastic piece 314*a* deforms from the state illustrated in FIG. 8A to the state illustrated in FIG. 8B, the elastic piece 314*a* has the bent portion 315*a* as described above and is therefore long enough to enable elastic deformation without producing plastic deformation.

Although the supply bobbin 302 is held in contact with the tip of the elastic piece 314*a* while being biased in the direction of an arrow C, the width of the tip of the elastic piece 314*a* is increased, and thus a stable attitude is maintained. Likewise, the winding bobbin 301 can be incorporated into the cassette case 304 from above in the state illustrated in FIGS. 7A and 7B. The winding bobbin 301 is incorporated by pushing the inclined surface 318*b* in the direction of the arrow B with the first shaft end part 301*e* of the winding bobbin 301. Accordingly, although the elastic piece 314*b* deforms from the state illustrated in FIG. 8A to the state illustrated in FIG. 8B, the elastic piece 314*b* has the bent portion 315*b* as described above and is therefore long enough to enable elastic deformation without producing plastic deformation. The winding bobbin 301 is held while being biased in the direction of the arrow C by the elastic piece 314*b*.

As illustrated in FIG. 7A, the cassette case 304 includes rotation restricting portions 319*a* and 319*b* on the supply bobbin 302 and the winding bobbin 301 sides, respectively, of the mounting direction far-side connecting portion 304*b*. When incorporated into the cassette case 304, the supply bobbin 302 is biased by the elastic piece 314*a* toward the far side in the mounting direction, where the rotation restricting portion 319*a* is provided, and thus the rotation restricting portion 319*a* engages with the rotation-restricted portion 302*c* of the supply bobbin 302, as illustrated in FIG. 9. Accordingly, when the ink cassette 300 is not mounted in the printer 100, the rotation restricting portion 319*a* and the rotation-restricted portion 302*c* engage, and the rotation of the supply bobbin 302 incorporated into the ink cassette 300 is restricted as a result. Likewise, when the ink cassette 300 is not mounted in the printer 100, the rotation restricting portion 319*b* and the rotation-restricted portion 301*c* engage, and the rotation of the winding bobbin 301 incorporated into the ink cassette 300 is restricted as a result.

Figure 11A:
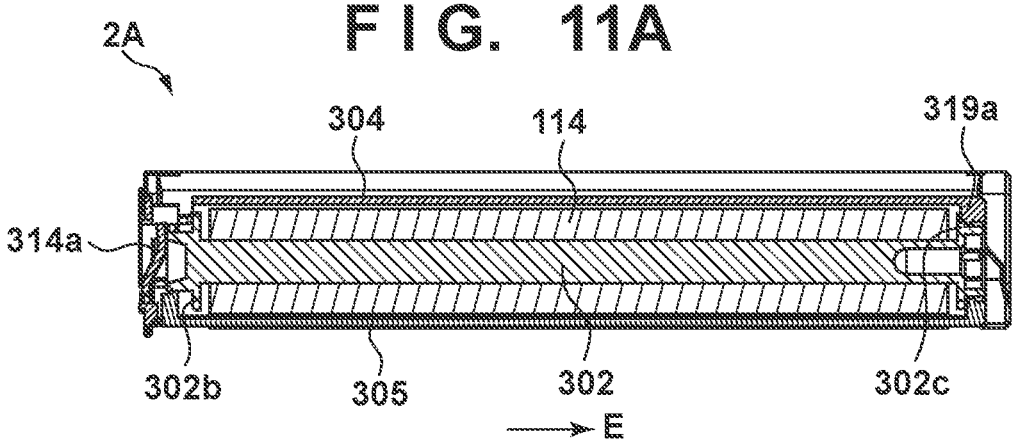
FIGS. 11A to 11D are diagrams illustrating operations in a state in which the ink cassette 300 is not mounted and is mounted in the printer 100.
Figure 11B:
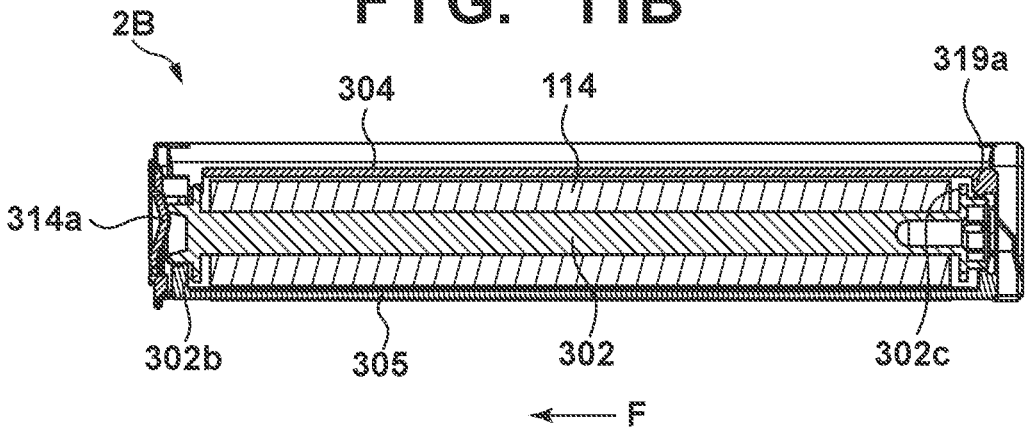
Figure 11C:
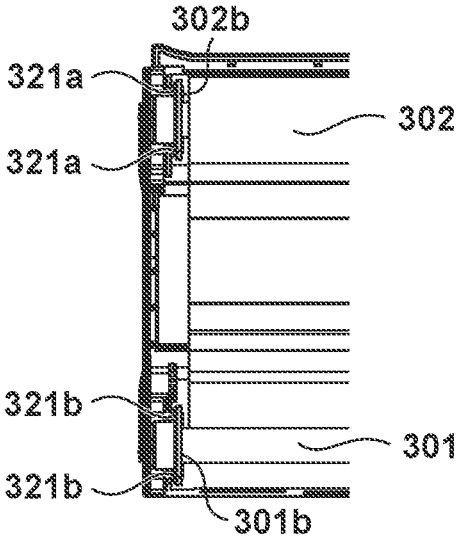

As illustrated in FIG. 11C, contact portions 321*a* and 321*b* are provided on the supply bobbin 302 side and winding bobbin 301 side, respectively, of the near side of the cassette case 304 in the mounting direction. The contact portion 321*a* is configured to be capable of making contact with the flange 302*b* of the supply bobbin 302. The contact portion 321*b* is configured to be capable of making contact with the flange 301*b* of the winding bobbin 301.

Figure 10:
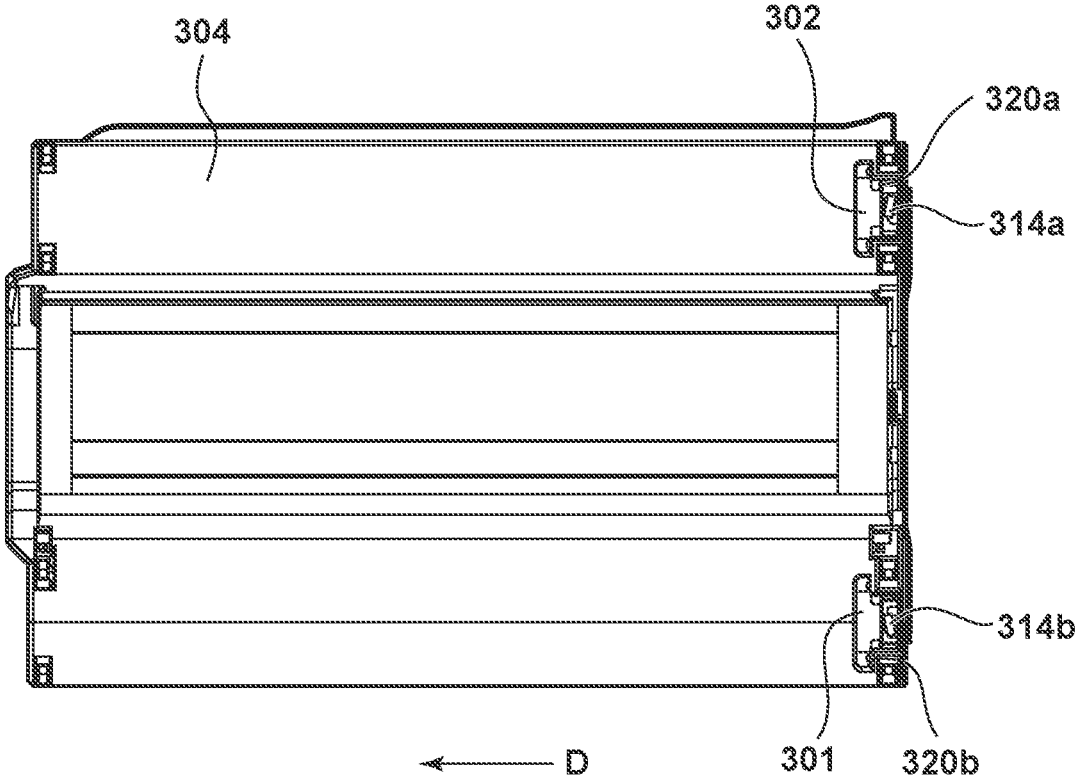
FIG. 10 is a plan view of the ink cassette 300.

FIG. 10 is a plan view of the ink cassette 300. A hole 320*a* and a hole 320*b* are provided in a upper surface of the cassette case 304, on the near side in the mounting direction. When the ink cassette 300 is assembled, the supply bobbin 302 and the elastic piece 314*a* can be seen by the user from the hole 320*a* As such, the user can confirm whether or not an assembly position of the supply bobbin 302 is biased in the direction of an arrow D by the elastic piece 314*a* and is therefore in a correct position. Likewise, the winding bobbin 301 and the elastic piece 314*b* can be seen by the user from the hole 320*b*, and the user can therefore confirm whether or not an assembly position of the winding bobbin 301 is biased in the direction of the arrow D by the elastic piece 314*b* and is therefore in a correct position.

Figure 11D:
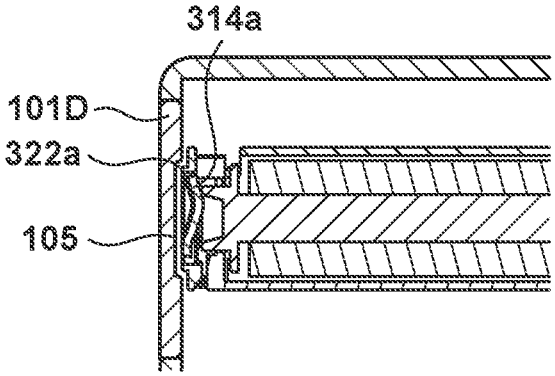

FIG. 11A is a cross-sectional view taken in the axial direction of the ink cassette 300 when the ink cassette 300 is not mounted in the printer 100. FIG. 11B is a cross-sectional view taken in the axial direction of the ink cassette 300 when the ink cassette 300 is mounted in the printer 100. FIG. 11C is a diagram illustrating positions of the supply bobbin 302 and the winding bobbin 301 on the near side in the mounting direction when the ink cassette 300 is mounted in the printer 100. FIG. 11D is a diagram illustrating positions of the cassette cover 101D and the ink cassette 300 on the near side in the mounting direction when the ink cassette 300 is mounted in the printer 100.

As illustrated in FIG. 11A, when the ink cassette 300 is not mounted in the printer 100, the supply bobbin 302 is biased in the direction of an arrow E by the elastic piece 314*a*, and the rotation-restricted portion 302*c* engages with the rotation restricting portion 319*a* of the cassette case 304, which restricts the rotation of the supply bobbin 302. Likewise, the winding bobbin 301 is biased in the direction of the arrow E by the elastic piece 314*b*, and the rotation-restricted portion 301*c* engages with the rotation restricting portion 319*b* of the cassette case 304, which restricts the rotation of the winding bobbin 301.

As illustrated in FIG. 11B, when the ink cassette 300 is mounted in the printer 100, a rotational member (not shown) provided in the printer 100 contacts with the supply bobbin 302 and the winding bobbin 301, and pushes the supply bobbin 302 and the winding bobbin 301 in the direction of an arrow F. The elastic piece 314*a* and the elastic piece 314*b* elastically deform in the direction of the arrow F, and the supply bobbin 302 and the winding bobbin 301 therefore move in the direction of the arrow F. At this time, the rotation-restricted portion 302*c* of the supply bobbin 302 and the rotation restricting portion 319*a* of the cassette case 304 disengage. Likewise, the rotation-restricted portion 301*c* of the winding bobbin 301 and the rotation restricting portion 319*b* of the cassette case 304 disengage. At this time, as illustrated in FIG. 11C, the flange 302*b* of the supply bobbin 302 and the contact portion 321*a* of the cassette case 304 are held in a state of contact. Likewise, the flange 301*b* of the winding bobbin 301 and the contact portion 321*b* of the cassette case 304 are held in a state of contact. Through this, the supply bobbin 302 and the winding bobbin 301 will not move further in the direction of the arrow F from the position illustrated in FIG. 11B, and thus the ink ribbon 114 can be fed out from the ink cassette 300 in a stable manner.

As illustrated in FIG. 11D, when the ink cassette 300 is mounted in the printer 100 and the cassette cover 101D is closed, the projection portion 322*a* of the near side of the cassette case 304 in the mounting direction fits with the recess portion 105 of the cassette cover 101D. This makes it possible to suppress an increase in the size of the printer 100. Additionally, when the supply bobbin 302 (the winding bobbin 301) has moved as far as a position where the flange 302*b* (301*b*) of the supply bobbin 302 (the winding bobbin 301) makes contact with the contact portion 321*a* (321*b*), the projection portion 322*a* (322*b*) projects further outward in the axial direction than the elastic piece 314*a* (314*b*). By using such a configuration, even if the supply bobbin 302 (the winding bobbin 301) is moved toward the elastic piece 314*a* (314*b*), the elastic piece 314*a* (314*b*) will not move past the projection portion 322*a* (322*b*; not shown) and make contact with the recess portion 105. Although there is a risk of the elastic piece 314*a* (314*b*) deforming if the elastic piece 314*a* (314*b*) presses against the recess portion 105, a configuration such as this makes it possible to protect the elastic piece 314*a* (314*b*).

Figure 12A:
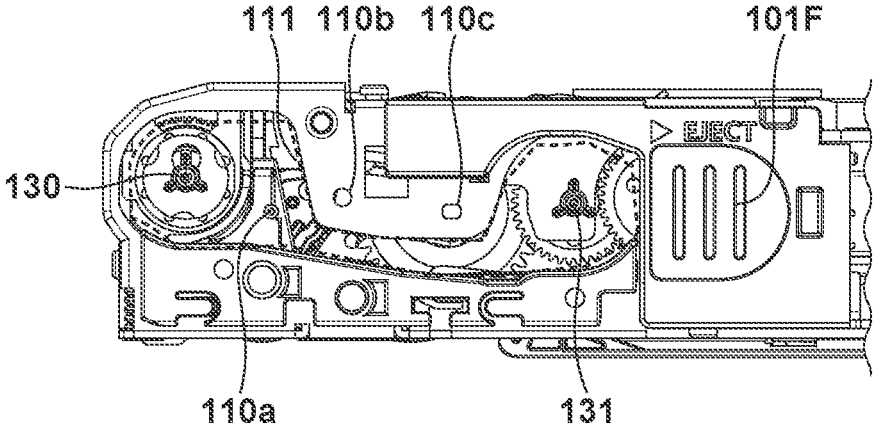
FIGS. 12A to 12C are cross-sectional views of the inside of the printer as seen from the mounting direction of the ink cassette.
Figure 12B:
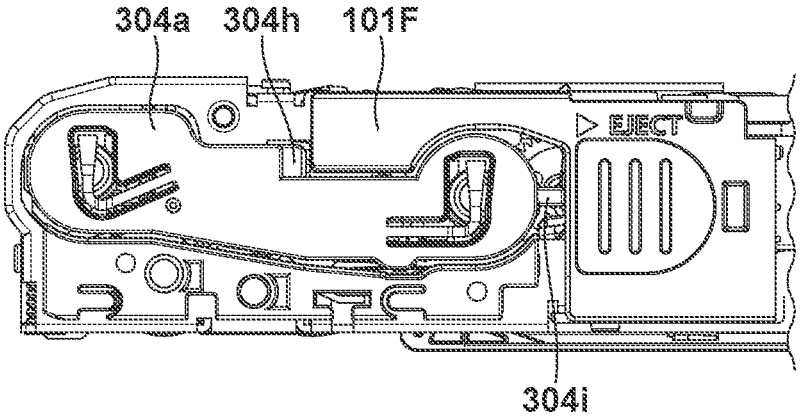
Figure 12C:
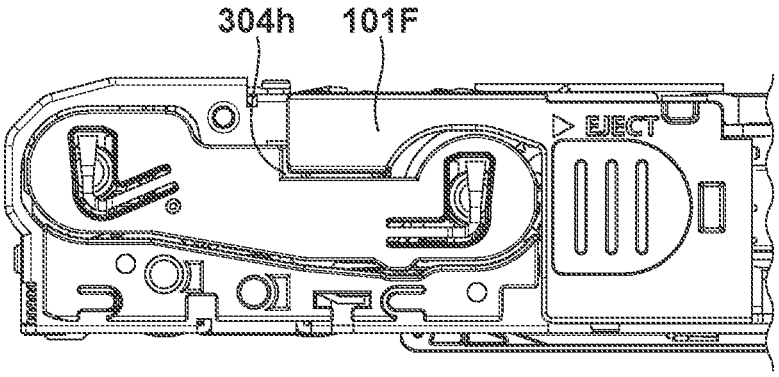

FIGS. 12A to 12C are diagrams illustrating the interior of the printer 100 from the direction of the arrow A1 in FIG. 2, i.e., from the mounting direction of the ink cassette 300. FIG. 12A illustrates a state in which the ink cassette 300 is not mounted; FIG. 12B, a state partway through mounting the ink cassette 300; and FIG. 12C, a state in which the mounting of the ink cassette 300 is complete.

A mechanism section for mounting the ink cassette 300 in the printer 100 will be described next with reference to FIGS. 3A and 3B, 4, and 12A to 12C. A main body positioning hole 304*g* is provided in the mounting direction near-side connecting portion 304*a* near the winding bobbin cover 306, and when the printer 100 is mounted, the main body positioning hole 304*g* engages with a positioning boss 110*b* provided in the chassis 110, which positions the ink cassette 300 with the printer 100. Additionally, a first positioning boss 304*j* and a second positioning boss 304*k* are provided in a back surface of the mounting direction near-side connecting portion 304*a* (a surface on the far side in the mounting direction). When the ink cassette 300 is mounted in the printer 100, the first positioning boss 304*j* and the second positioning boss 304*k* engage with a positioning round hole 110*c* and a positioning long hole 110*d*, respectively, provided in the chassis 110, which positions the ink cassette 300 with the printer 100. A guide rail 304*i* is provided on aside surface of the cassette case 304, on the right side of the ink cassette 300 in the drawings. As illustrated in FIG. 12B, the guide rail 304*i* is inserted while pushing the cassette lever 101F to the right side in the drawing, as the ink cassette 300 is mounted in the printer 100. Once the mounting is complete, the guide rail 304*i* separates from the cassette lever 101F, as illustrated in FIG. 12C. Upon doing so, the cassette lever 101F is moved to the left side in the drawing by a biasing mechanism (not shown), and therefore returns to the initial position illustrated in FIG. 12A. At this time, an end part of the cassette lever 101F engages with a cassette lever engaged portion 304*h*, which is formed in a central part of the mounting direction near-side connecting portion 304*a* and is recessed by one level. When the ink cassette 300 is mounted, the winding bobbin support portion 130 and the supply bobbin support portion 131 of the printer 100 press the winding bobbin 301 and the supply bobbin 302 using coil springs (not shown). At this time, a force in a non-mounting direction, which is the direction opposite from the direction of mounting in the printer 100 (the direction of the arrow A2, which is opposite from the arrow A1 in FIG. 2), acts on the ink cassette 300, but the cassette lever engaged portion 304*h* engages with the cassette lever 101F, which locks the ink cassette 300 in a state in which it is mounted in the printer 100. The cassette mounting portion 111, which is indicated by the dotted line in FIG. 12A, is, when excluding the portion in which the cylinder containing the ink ribbon 114 is inserted, an extremely narrow space. This narrow portion has a shape which follows the path of the ink ribbon 114 which is guided from the supply bobbin 302 to the winding bobbin 301. With the ink cassette 300 according to the present embodiment, it is necessary for the mounting direction far-side connecting portion 304*b* to pass through this narrow portion, and the shape therefore has an extremely narrow projected area with respect to the mounting direction.

Figure 13B:
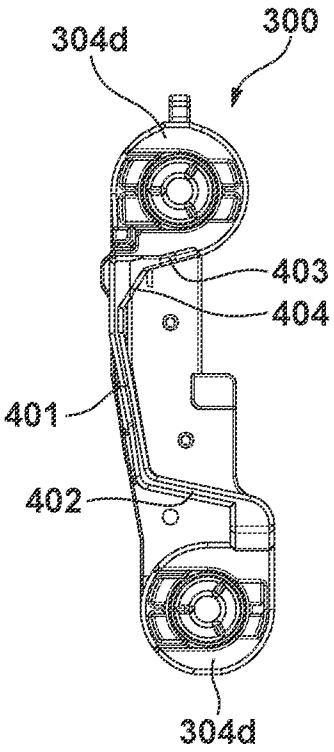
FIG. 13B is a side view of the ink cassette, seen from the far side in the mounting direction.
Figure 13A:
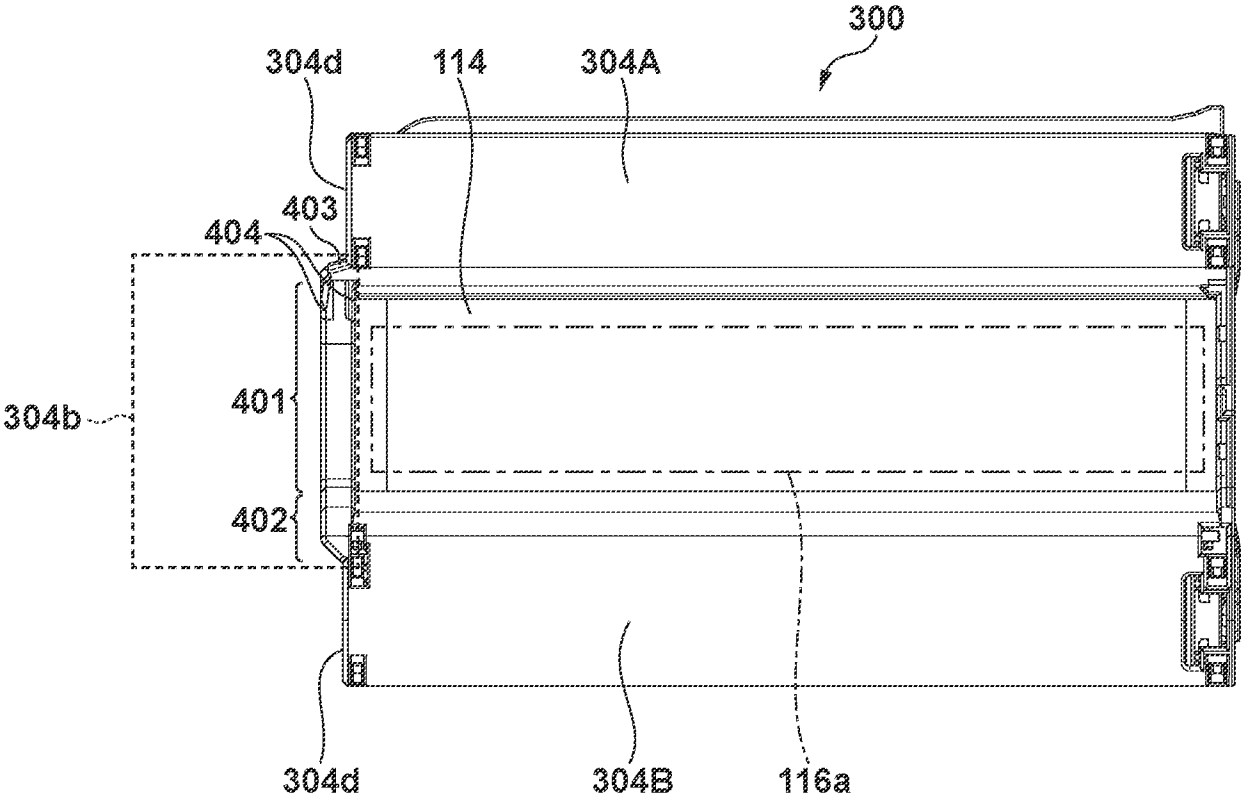
FIG. 13A is a plan view of the ink cassette.

FIG. 13A is a plan view of the ink cassette 300. FIG. 13B is a side view of the ink cassette 300, seen from the far side in the mounting direction.

The mounting direction far-side connecting portion 304*b* has the following configuration in order to connect the supply bobbin storage portion 304A, which holds the supply bobbin 302, with the winding bobbin storage portion 304B, which holds the winding bobbin 301, at the far side of the cassette case 304 in the mounting direction, and in order to protect the ink ribbon 114 during mounting.

The mounting direction far-side connecting portion 304*b* includes: a first projecting portion 401, which extends substantially parallel to the path of the ink ribbon 114 from the supply bobbin 302 to the winding bobbin 301 and projects toward the far side in the mounting direction; a second projecting portion 402, which extends along the winding bobbin-side guide wall 304*f* from a winding bobbin-side end part of the first projecting portion 401 and projects toward the far side in the mounting direction; and a third projecting portion 403, which extends along the supply bobbin-side guide wall 304*e* from a supply bobbin-side end part of the first projecting portion 401 and projects toward the far side in the mounting direction. The second projecting portion 402 connects to the winding bobbin storage portion 304B along a second projecting portion-side end part, at a side surface portion of the winding bobbin storage portion 304B on the far side thereof in the mounting direction. The third projecting portion 403 connects to the supply bobbin storage portion 304A along a third projecting portion-side end part, at the side surface portion of the supply bobbin storage portion 304A on the far side thereof in the mounting direction. The first projecting portion 401, the second projecting portion 402, and the third projecting portion 403 are substantially U-shaped when viewed from the far side in the mounting direction, and have a strength sufficient to resist a force that pushes the winding bobbin side and the supply bobbin side closer together than a straight line shape substantially parallel to the path of the ink ribbon 114. Additionally, substantially triangular reinforcement ribs 404 are formed in a connecting portion between the first projecting portion 401 and the third projecting portion 403 so as to be orthogonal to the mounting direction, which further enhances the rigidity. An end part of the second projecting portion 402 has a shape which covers the periphery of a side surface portion of the far side of the winding bobbin storage portion 304B in the mounting direction, in which a bearing portion is provided to support the guide shaft 303 that bends the conveyance path of the ink sheet. The second projecting portion 402 extends along the winding bobbin-side guide wall 304*f*, and extends as far as a covering position of the bearing portion supporting the guide shaft 303 that bends the conveyance path of the ink sheet. Accordingly, the second projecting portion 402 is connected along a second projecting portion-side end part of a bearing portion 304*d* on the far side of the winding bobbin storage portion 304B in the mounting direction, which increases the strength of the connection.

Note that the mounting direction near-side connecting portion 304*a* is constituted by a thin, substantially planar plate member having as broad a surface area as possible, and by connecting the supply bobbin storage portion 304A and the winding bobbin storage portion 304B, the ink cassette 300 and the printer 100 can be made compact in the mounting direction. In FIGS. 13A and 13B, a position the thermal head 116 approaches during printing is indicated by a single-dotted line 116*a*. The mounting direction far-side connecting portion 304*b* is provided having a shape, and at a position, which do not interfere with the thermal head 116 moving in the region indicated by the single-dotted line 116*a*. If an end part of the bearing portion 304*d* on the far side of the cassette case 304 in the mounting direction extends as far as the position of the end face of the mounting direction far-side connecting portion 304*b*, it becomes necessary to provide a layout in which the winding bobbin support portion 130 and the supply bobbin support portion 131 of the printer 100 are retracted even further, which increases the size of the printer 100. As such, the bearing portion 304*d* on the far side of the cassette case 304 in the mounting direction is configured to fit within the minimum necessary amount of projection from the axial end part of the ink ribbon. The ink cassette 300 according to the present embodiment is made compact so that the end part of the bearing portion 304*d* on the far side in the mounting direction is positioned essentially flush with the end parts of the winding bobbin 301 and the supply bobbin 302 on the far side in the mounting direction. The printer 100 is also made smaller in the mounting direction of the ink cassette 300 by providing the mounting direction far-side connecting portion 304*b* with a shape that projects further toward the far side in the mounting direction than the end part of the bearing portion 304*d* on the far side in the mounting direction, i.e., the end parts of the winding bobbin 301 and the supply bobbin 302.

Next, a configuration which makes the printer 100 according to the present embodiment more compact in the mounting direction of the ink cassette 300 will be described with reference to FIGS. 14 to 17.

Figure 14:
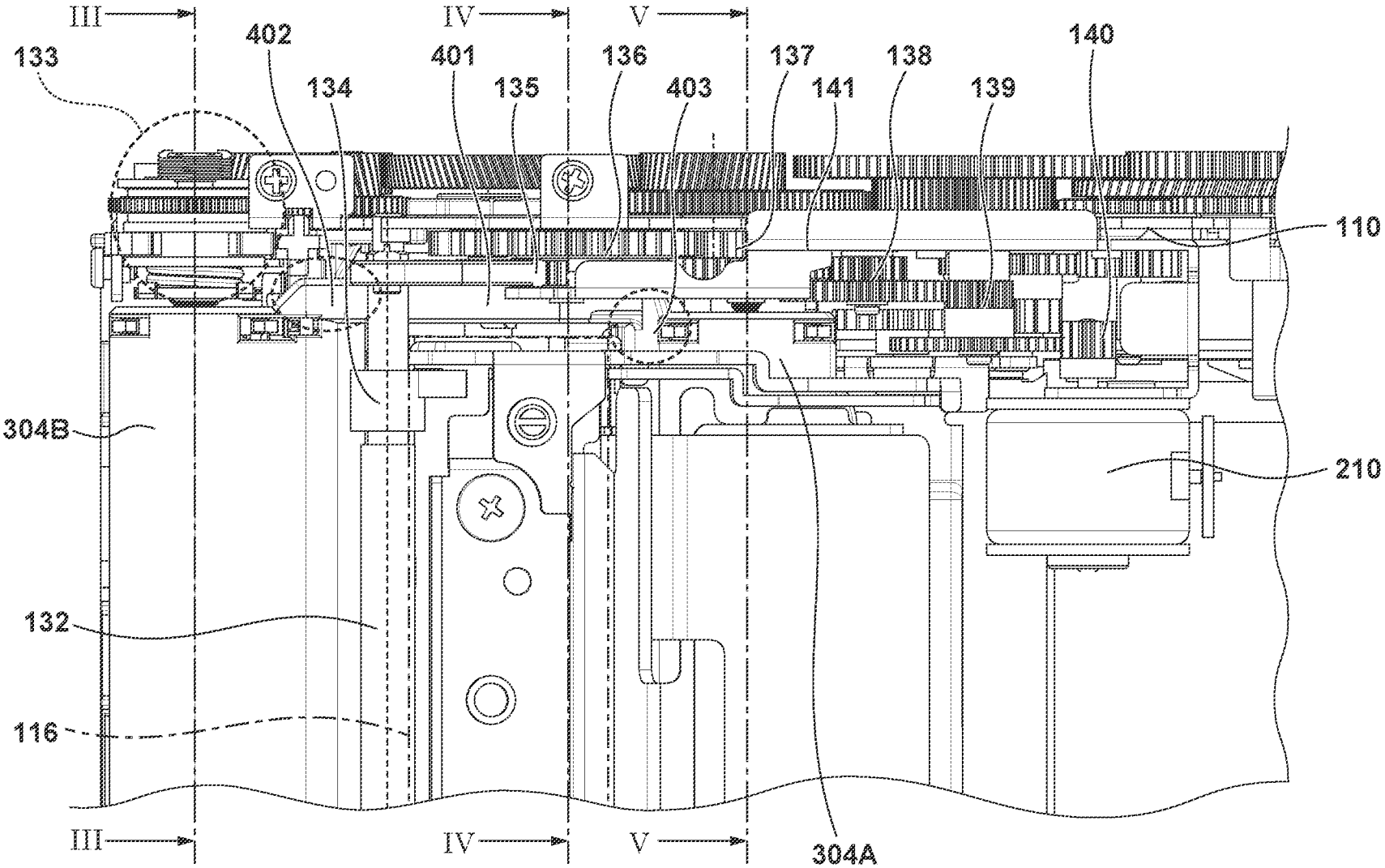
FIG. 14 is a plan view illustrating the vicinity of a far side, in the mounting direction, of the interior of the printer in which the ink cassette is mounted.
Figure 15:
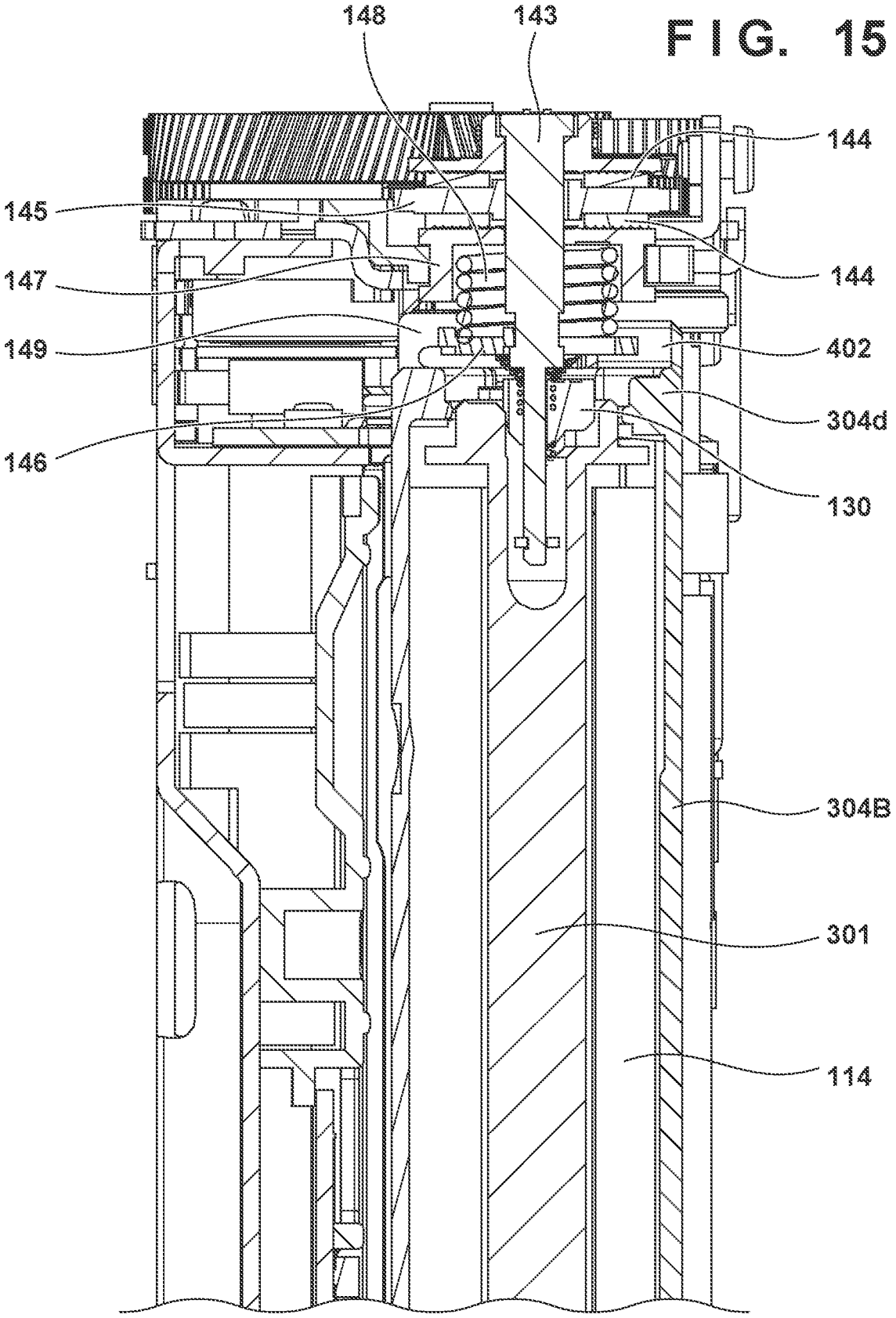
FIG. 15 is a cross-sectional view taken along a line III-III shown in FIG. 14.
Figure 16:
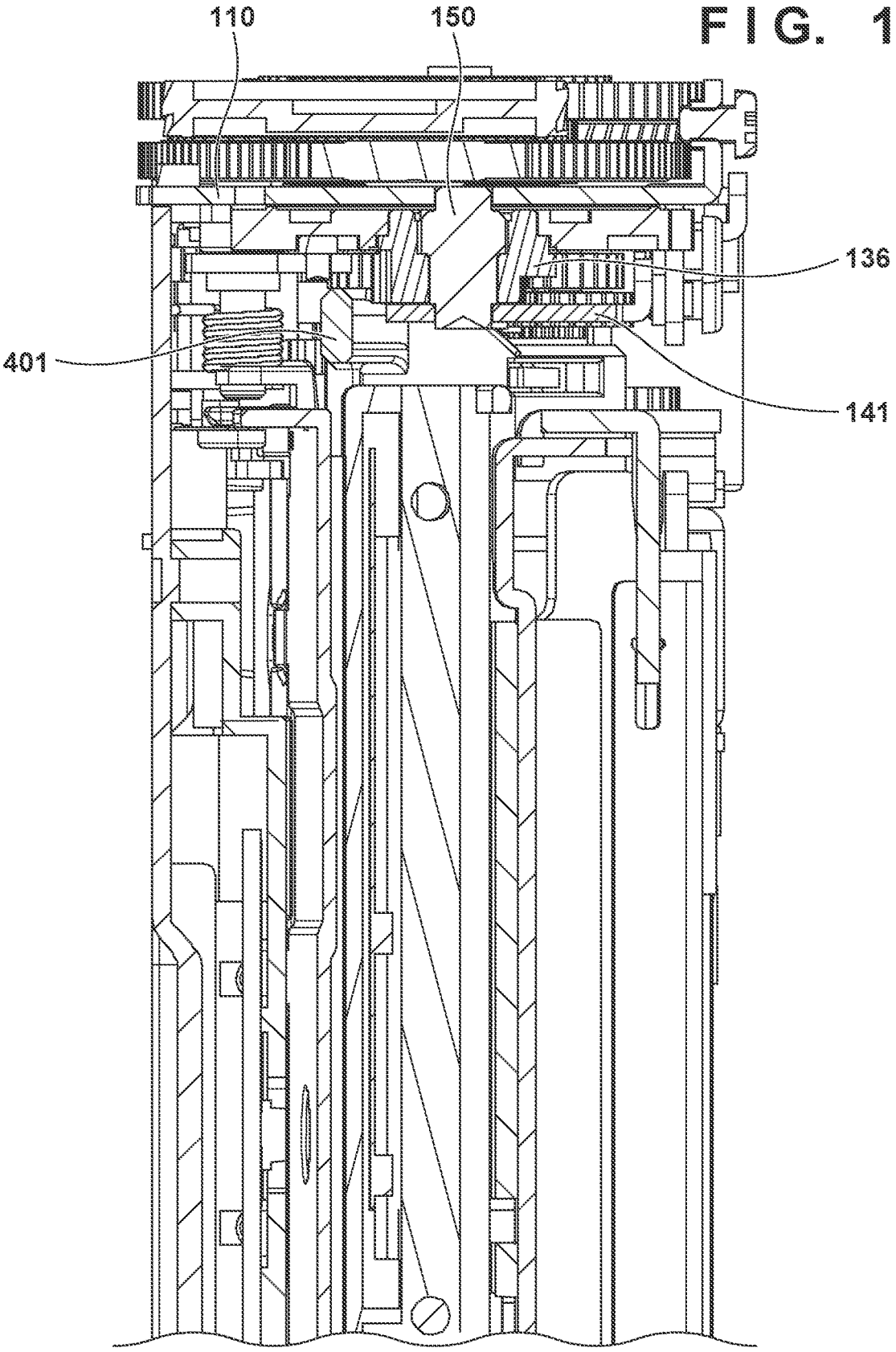
FIG. 16 is a cross-sectional view taken along a line IV-V shown in FIG. 14.
Figure 17:
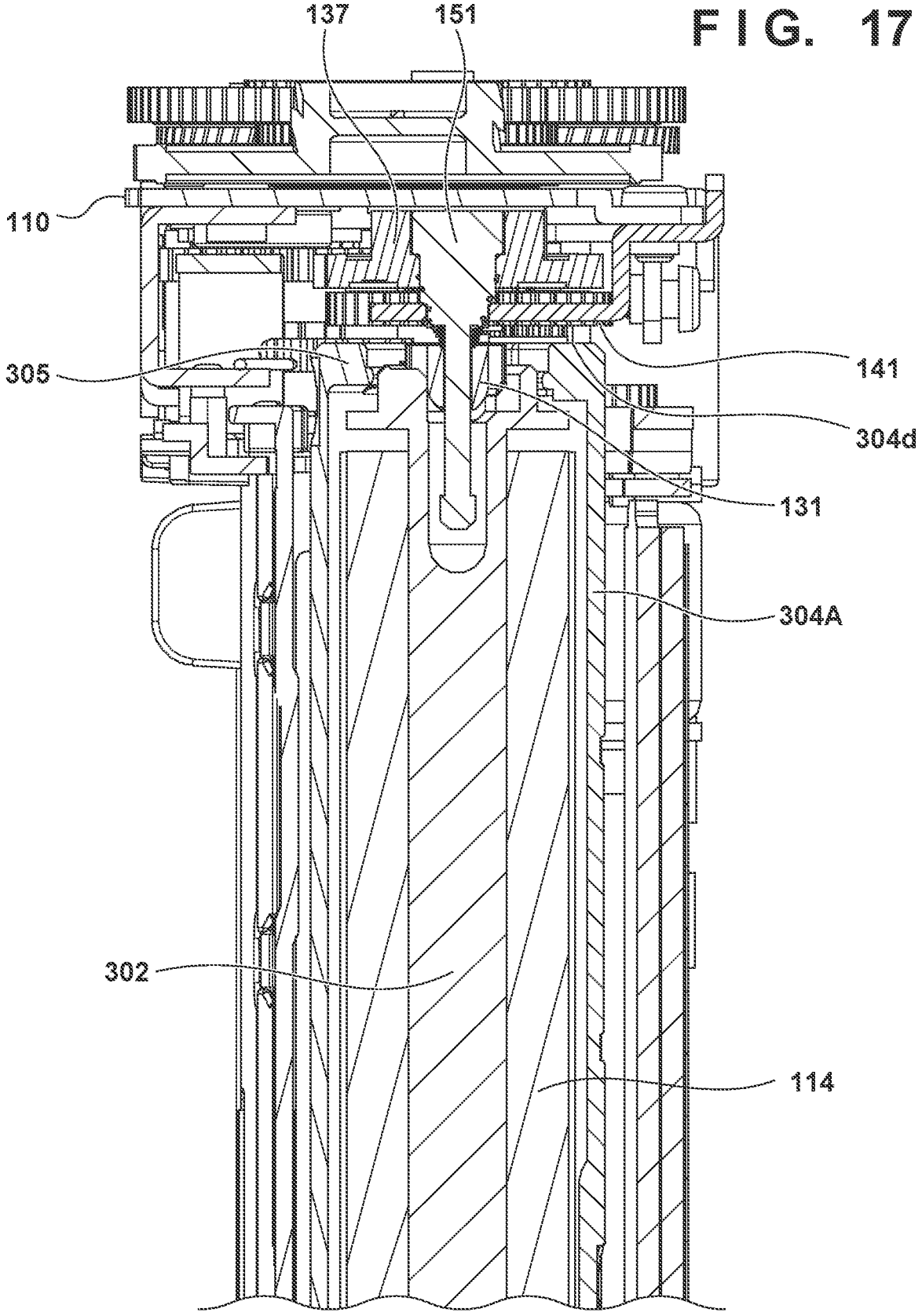
FIG. 17 is a cross-sectional view taken along a line V-V shown in FIG. 14.

FIG. 14 is a plan view of the vicinity of the far side of the printer interior in the mounting direction, in a state where the ink cassette 300 is mounted in the printer 100. FIGS. 15, 16, and 17 are cross-sectional views taken along lines III-III, IV-IV, and V-V in FIG. 14, respectively.

An end part of the winding bobbin storage portion 304B of the ink cassette 300 on the far side in the mounting direction, located on the left side in FIGS. 13A and 13B, is in a positional relationship of facing a torque limiter 133. The torque limiter 133 is part of an ink ribbon winding mechanism for producing a winding force having a constant torque. Details will be given with reference to FIG. 15. In the torque limiter 133, a limit gear 146, which is interposed between two felt members 145, is supported so as to be capable of pivoting, between an inner side of an end part holder 144 locked to an end part of a winding shaft 143 and an inner side of an inner holder 147. On the other hand, the end part holder 144 and the inner holder 147 are engaged to the winding shaft 143 in a locked state so that the winding shaft 143 does not rotate. Likewise, a holding plate 149 supported on the axis of the winding shaft 143 at a set distance from the inner holder 147 is fixed. A powerful compression spring 148 is fitted between the inner holder 147 and the holding plate 149 in a compressed state. Through this configuration, the limit gear 146 is in a state where both surfaces thereof are held by the felt members 145 due to the restorative force of the compression spring 148 and are therefore braked. The winding bobbin support portion 130 is axially supported by the winding shaft 143, in a state where the rotation of the winding bobbin support portion 130 is stopped, beyond the holding plate 149 of the winding shaft 143, and is engaged with the bobbin engagement portion 301*d* of the winding bobbin 301 of the ink cassette 300. Accordingly, when the torque limiter 133 is rotated by a driving mechanism (not shown), the winding bobbin support portion 130 rotates and rotates the winding bobbin 301, and the ink ribbon 114 is wound up within the ink cassette 300. During printing, the printing is performed while the ink ribbon 114 is advanced while being pressed against the recording sheet 113 by the thermal head 116 at a strong force of at least 3 N. The ink ribbon 114 is then separated from the recording sheet 113 and wound up. Accordingly, if the ink ribbon 114 is wound beyond a permissible tension, the ink ribbon 114 will be damaged, by being wrinkled, broken, or the like, particularly at the area where the ink ribbon 114 separates from the recording sheet 113. Therefore, the configuration is such that the torque limiter 133 produces slippage between the felt members 145 and the limit gear 146 when a torque greater than a set torque is produced in the winding bobbin 301, and no more than a certain amount of tension acts on the ink ribbon 114. Based on the above-described requirement to configure a slipping mechanism with the strong compression spring 148, the torque limiter 133 requires a space in the axial direction. Accordingly, if it is possible to protrude even slightly toward the ink cassette 300 within the printer 100, the printer 100 can be made more compact. Additionally, as illustrated in FIG. 15, when the ink cassette 300 is mounted, part of the torque limiter protrudes toward the ink cassette 300, and at a side part of the second projecting portion 402 of the mounting direction far-side connecting portion 304*b* of the ink cassette 300, the compression spring 148 and the holding plate 149 of the torque limiter 133 are disposed at a position facing the end part 304*d* of the winding bobbin storage portion 304B of the ink cassette 300. This makes it possible to make the space on the far side of the ink cassette 300 in the mounting direction more compact.

Constituent elements of the printer 100 located above the first projecting portion 401 of the mounting direction far-side connecting portion 304*b* will be described next.

A head drive shaft 132 is a metal shaft, and serves as a rotation shaft of a head raising/lowering lever 134 which raises and lowers the thermal head 116. A sector gear 135 is also press-fitted into the head drive shaft 132. Using a position changing motor 210 as a drive source, power is transmitted to a pinion gear 140, a first reduction gear 139, a second reduction gear 138, a third reduction gear 137, and a fourth reduction gear 136. The fourth reduction gear 136 is a two-stage gear, and the sector gear 135 meshes with the smaller gear side thereof. The position changing motor 210 is a stepping motor, and by performing rotational control, the phase of the fourth reduction gear 136 is controlled and the sector gear 135 is rotated. A reduction gear row for sheet convey driving is provided on an outside surface of a side wall portion on the far side of the chassis 110 in the mounting direction, and a reduction gear row for a raising/lowering mechanism of the thermal head 116 is disposed on the inside surface opposite from the stated outside surface. Using such a layout, in which the two reduction gear rows are divided between the inner side and outer side of the side wall portion of the chassis 110, achieves a compact size.

The size can be made even more compact by using a layout in which the supply bobbin storage portion 304A on the far side of the ink cassette 300 in the mounting direction is disposed in a position facing the thermal head 116 so as to intersect with part of the ink cassette 300. FIG. 16 is a cross-sectional view of the fourth reduction gear 136 seen from a central position thereof. The fourth reduction gear 136 is fixed to a gear support frame 141, which in turn is fixed to the chassis 110, and a tip of the fourth reduction gear 136 is rotatably supported by a shaft 150 which is fitted to the chassis 110. Here, part of the gear support frame 141 and part of the fourth reduction gear 136 are disposed so as to overlap vertically with the first projecting portion 401 of the mounting direction far-side connecting portion 304*b* of the ink cassette 300, which makes it possible to effectively use the space within the printer and achieve a compact size. FIG. 17 is a cross-sectional view of the supply bobbin 302 taken from an axial center thereof. In the printer 100 according to the present embodiment, the gear support frame 141 is provided opposite the end part of the bearing portion 304*d* on the far side of the ink cassette 300 in the mounting direction. The third reduction gear 137 is rotatably supported by a shaft 151, which is fixed to the chassis 110, on an inner side of the gear support frame 141. The supply bobbin support portion 131 is similarly rotationally supported by the shaft 151, and is engaged with the bobbin engagement portion 301*d* of the supply bobbin 302 of the ink cassette 300. When the ink cassette 300 is mounted, the supply bobbin 302 engages with the supply bobbin support portion 131, and therefore rotates at a defined position about the shaft 151. A compact size can be realized, and costs can be reduced as well, by using the same shaft 151 as the support shaft of the supply bobbin support portion 131 and the rotational shaft of the third reduction gear 137. Additionally, when the ink cassette 300 is mounted, part of the raising/lowering mechanism of the thermal head 116 projects toward the ink cassette 300, and the gear row of the raising/lowering mechanism is disposed in a position facing the end part 304*d* of the supply bobbin storage portion 304A of the ink cassette 300 at a side part of the third projecting portion 403 of the mounting direction far-side connecting portion 304*b* of the ink cassette 300. As such, the space on the far side of the ink cassette 300 in the mounting direction can be made more compact.

Control Configuration

Figure 18:
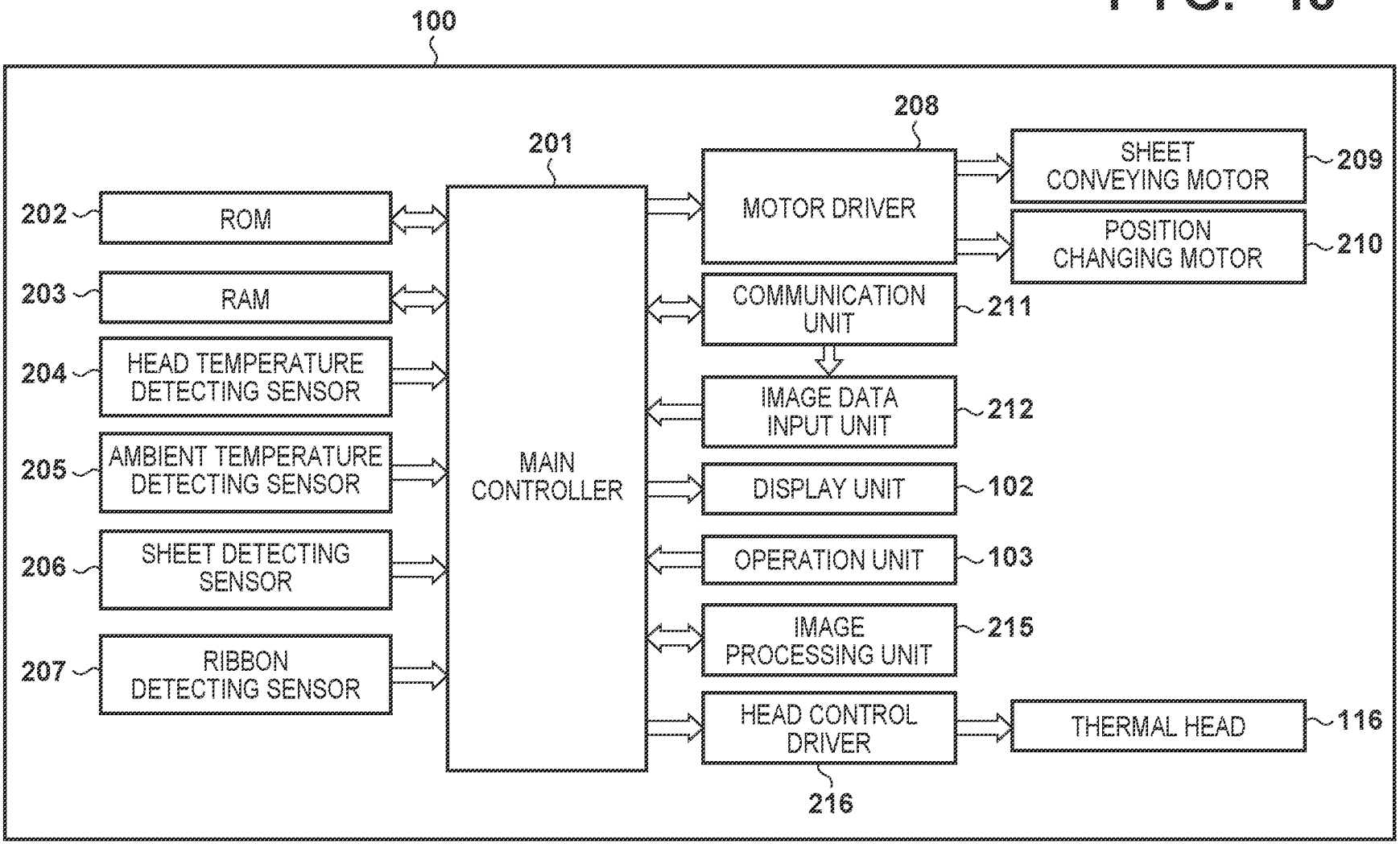
FIG. 18 is a block diagram illustrating the internal configuration of the printer.

The internal configuration of the printer 100 according to the present embodiment will be described next with reference to FIG. 18. FIG. 18 is a block diagram illustrating the internal configuration of the printer 100 according to the present embodiment.

A main controller 201 includes an interface circuit which exchanges data with the respective constituent elements of the printer 100 (described later), a CPU, an MPU, and the like that perform computational processing for controlling the operations of the printer 100 as a whole, and so on. ROM 202 is non-volatile memory which stores a system control program of the printer 100. The main controller 201 loads the program from the ROM 202 and controls the respective constituent elements of the printer 100 on the basis of the loaded program. RAM 203 is volatile memory used for temporarily storing image data and performing operations for data processing.

A head temperature detecting sensor 204 detects the temperature of the thermal head 116 and outputs a detection result to the main controller 201. An ambient temperature detecting sensor 205 detects a temperature within the printer 100, and outputs a detection result to the main controller 201. On the basis of the detection results from the head temperature detecting sensor 204 and the ambient temperature detecting sensor 205, the main controller 201 performs various types of temperature control, such as temperature correction, weighted operations, and so on of the thermal head 116. The printer 100 furthermore includes sheet detecting sensors 206, which detect sheet, as sensors which detect information within the printer 100. In the printer 100 according to the present embodiment, the sheet detecting sensors 206 are provided at a plurality of locations, which makes it possible to accurately control the position of the sheet. Furthermore, the printer 100 includes a ribbon detecting sensor 207 that detects markers 114*a* for controlling the position of the ink ribbon 114. By executing programs on the basis of the information detected by the respective sensors, the main controller 201 outputs commands to a motor driver 208, and controls the driving of a sheet conveying motor 209 and the position changing motor 210.

The sheet conveying motor 209 drives and conveys the recording sheet 113 and the ink ribbon 114. The position changing motor 210 drives the raising/lowering mechanism, a phase switching mechanism, and the like which moves the thermal head 116 to a pressurized position or a retracted position. A communication unit 211 is capable of communicatively connecting to an external device and receiving image data, sending and receiving various types of control data and control results, and so on. An image data input unit 212 takes, from the communication unit 211, the image data received from the external device, and outputs that image data to the main controller 201. The main controller 201 outputs the image data received from the external device to an image processing unit 215.

The display unit 102 displays an operating state of the printer 100 through the LED emitting colored light, lighting up, flashing, or the like. The operating unit 103 is a power switch and an operating member that accepts other operating instructions made in the printer 100 by the user. The communication unit 211 also accepts operating instructions input from the external device, and communicates those operating instructions to the main controller 201. The image processing unit 215 performs various types of image processing on the image data accepted by the image data input unit 212. The image processing unit 215 performs various types of image processing on the image data, such as decoding processing, resizing processing based on the recording sheet, and image correction processing, and generates print data for printing from the image data which has been subjected to the image processing.

A head control driver 216 controls the thermal head 116. The print data generated by the image processing unit 215 is output to the head control driver 216. The print data input to the head control driver 216 is converted into an electrical signal and output to the heating element of the thermal head. In the heating element, the electrical signal is converted into thermal energy, which causes the ink on the ink ribbon 114 to be transferred to the recording sheet 113.

Figure 19:
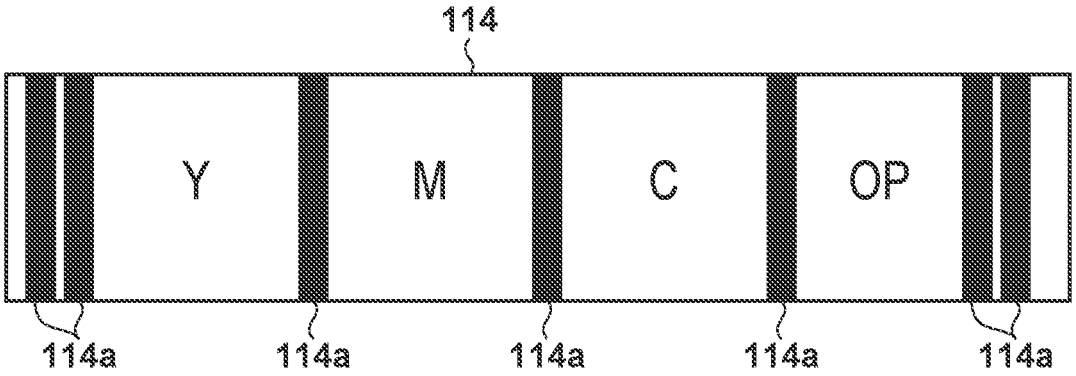
FIG. 19 is an expanded view of an ink ribbon.

The configuration of the ink ribbon 114 will be described next with reference to FIG. 19. FIG. 19 is an expanded view of the ink ribbon 114 according to the present embodiment.

In the case of full-color printing, yellow (Y), magenta (M), and cyan (C) color inks are arranged on the ink ribbon 114. A full-color image is formed by overlaying each ink color on the recording sheet 113 to print an image, and an overcoat (OP) surface is furthermore formed on the image. Black band-shaped markers 114*a* are provided between each color of ink for the purpose of detecting the starting position of each color of ink, and two of the markers 114*a* are provided at the start of the yellow (Y) surface in order to distinguish yellow from the other colors. The ink ribbon according to the present embodiment uses a highly heat-resistant film, such as polyethylene terephthalate, with a thickness of approximately 2 to 10 or more microns, as a base material. The yellow (Y), magenta (M), and cyan (C) inks are sublimation inks prepared by mixing dyes, binders, plasticizers, binding agents, and the like, and have a thickness of approximately 0.2 to 5 μm on the film. The transparent and colorless overcoat surface is formed by applying a styrene derivative, styrene resin, styrene copolymer resin, a binder, or the like at a thickness of approximately 0.5 to 5 μm. On the surface on the side opposite from the surface to which the ink is applied, a lubricant is applied to reduce frictional resistance with the thermal head and stabilize the travel of the ink ribbon, an abrasive agent is applied to polish and clean the surface of the thermal head, and so on.

A sequence of operations performed when the printer 100 according to the present embodiment prints will be described next with reference to FIGS. 20A to 20E and 21A to 21B.

Figure 20A:
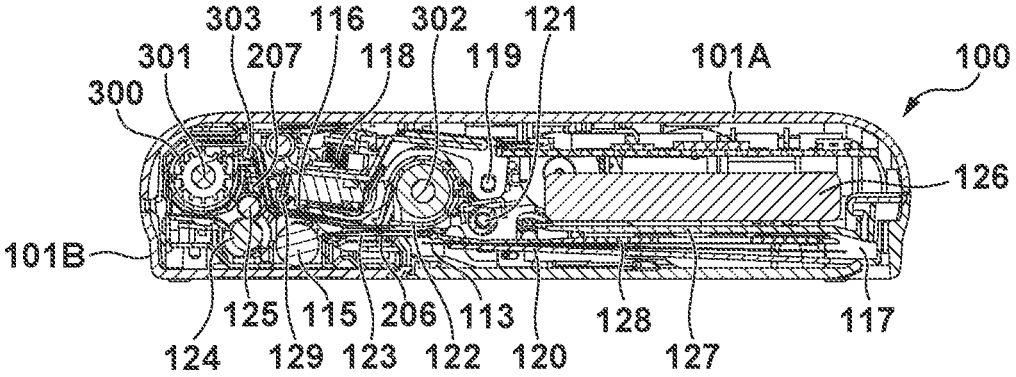
FIGS. 20A to 20E are cross-sectional side views illustrating operations when the printer is printing.
Figure 20B:
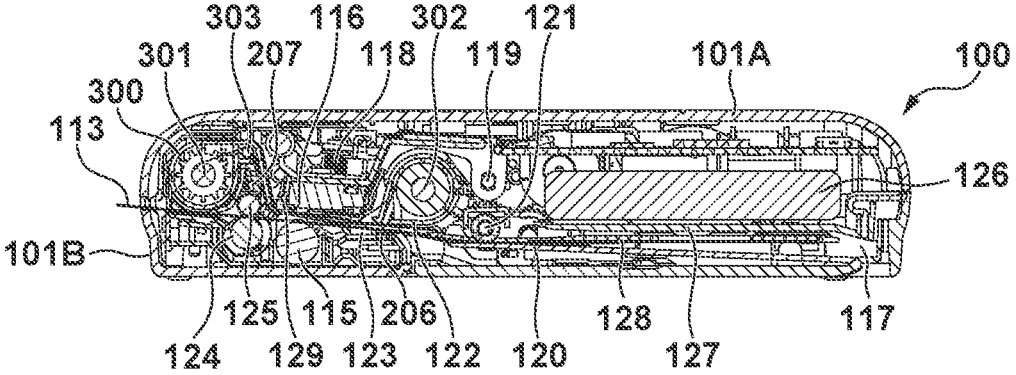
Figure 20C:
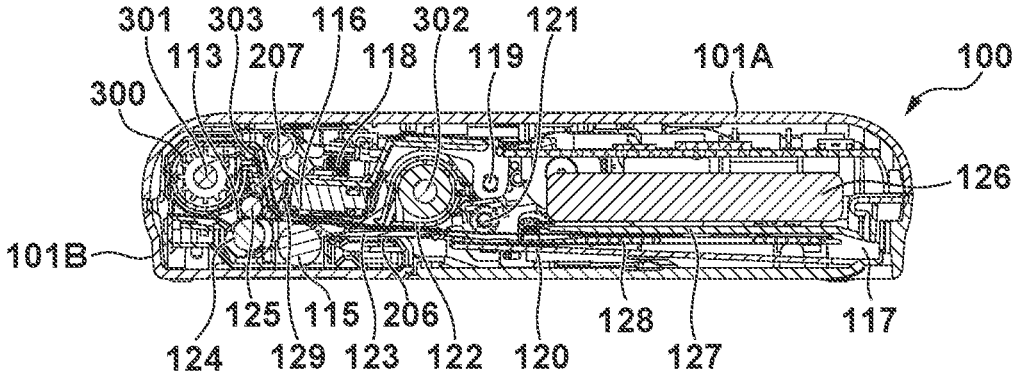
Figure 20D:
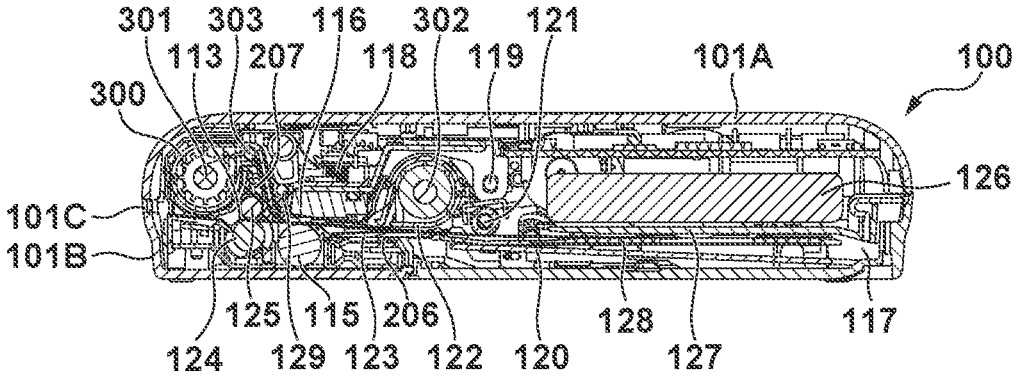
Figure 20E:
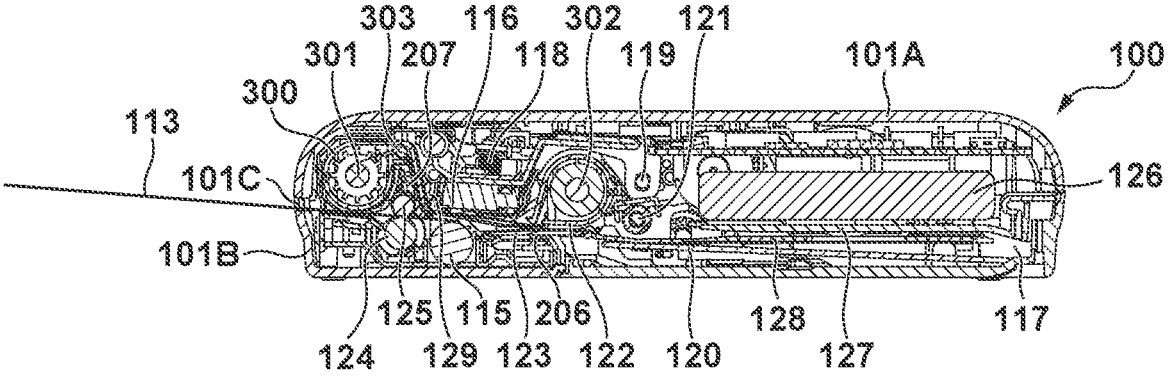
Figure 21A:
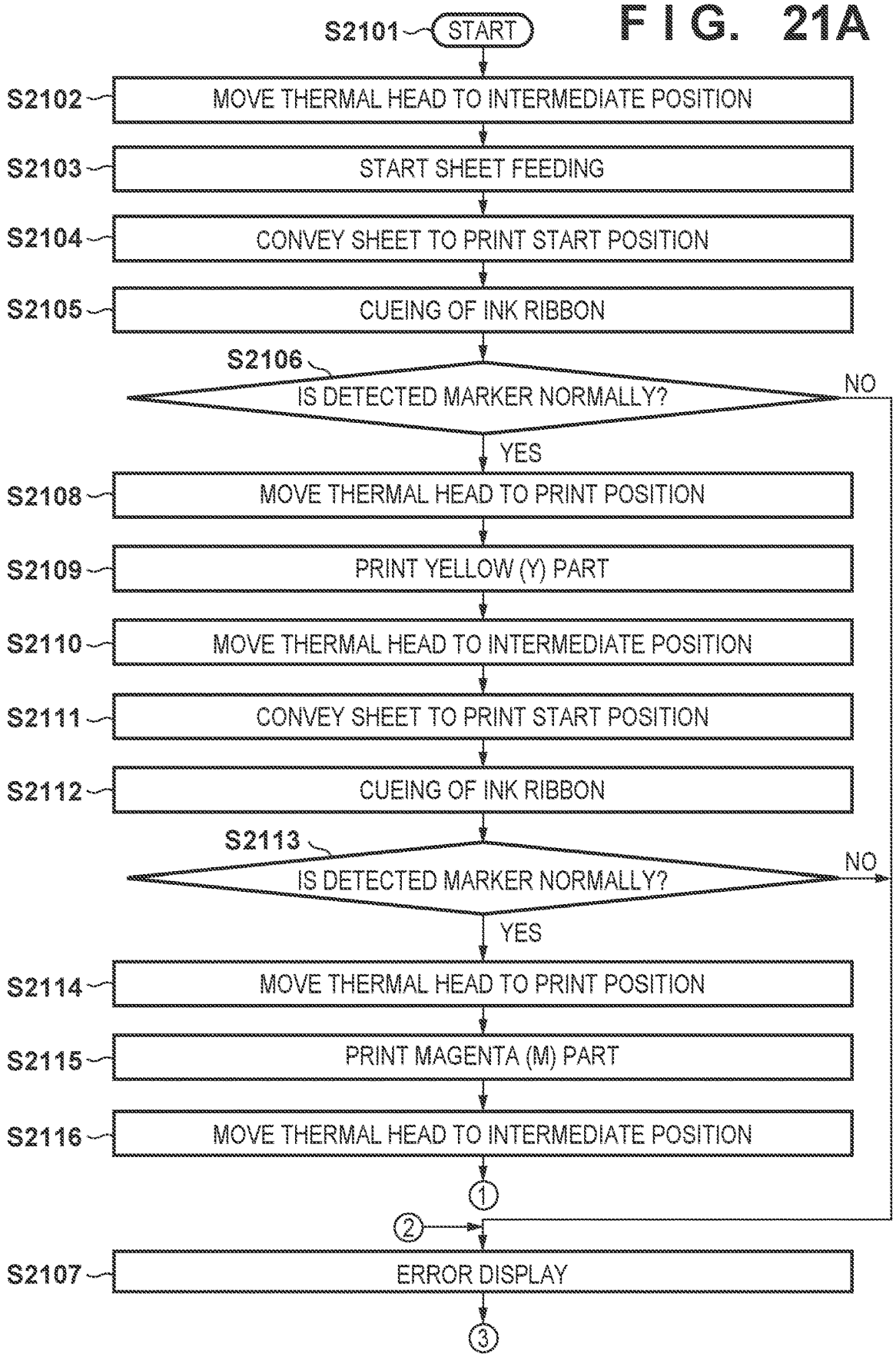
FIGS. 21A and 21B are flowcharts illustrating a processing sequence performed when the printer is printing.
Figure 21B:
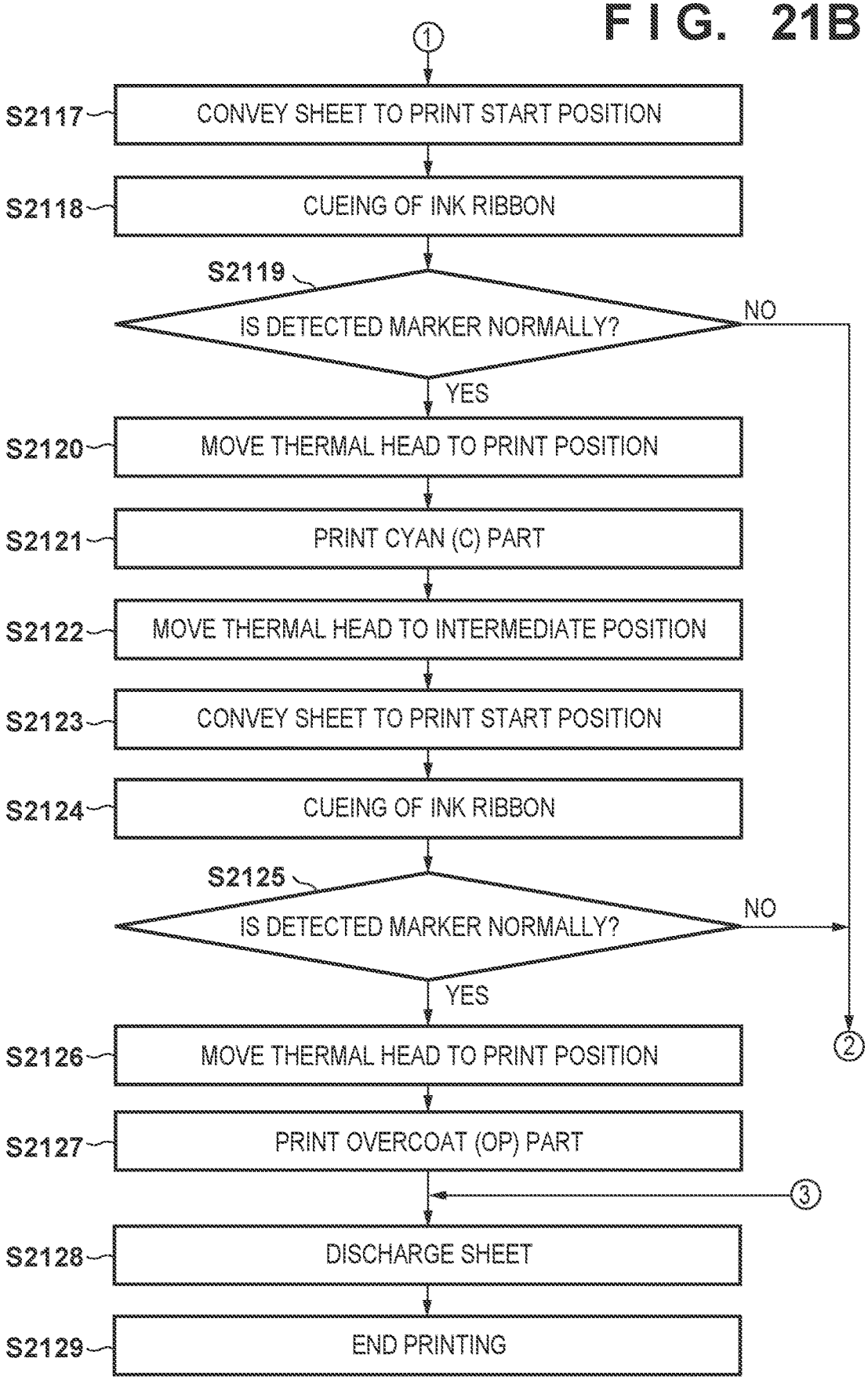

FIGS. 20A to 20E are cross-sectional side views illustrating operations performed when the printer 100 according to the present embodiment prints, where FIG. 20A illustrates a standby state; FIG. 20B, a sheet feed state; FIG. 20C, a printing start state; FIG. 20D, a pre-discharge state following the completion of printing; and FIG. 20E, a post-discharge state. FIGS. 21A and 21B are flowcharts illustrating a sequence of operations performed when the printer 100 according to the present embodiment prints.

When the user sets the ink cassette 300 in the printer 100, loads the recording sheet 113 into the sheet storage unit 117, and turns the power on using the operating unit 103, the printer 100 enters the standby state. When, in the standby state, image data begins being received from a host device, the LED of the display unit 102 flashes to indicate that the data is being loaded. The printer 100 includes a platen roller 115 and the thermal head 116. The thermal head 116 is rotatably supported by a thermal head support shaft 119, and is biased by a coil spring 118 in what is the clockwise direction in the drawings. The thermal head 116 is restricted to a position that maximizes the distance from the platen roller 115 so as not to interfere with the ink cassette 300 during mounting.

Next, when image data to be printed is designated in the host device and a printing instruction is made, the printer 100 receives the printing instruction from the host device and starts printing operations (step S2101). Upon the printing operations being started, the printer 100 uses a driving mechanism (not shown) to cause the thermal head 116 to rotate, in what is the counterclockwise direction in the drawings, about the thermal head support shaft 119, against a biasing force produced by the coil spring 118. As illustrated in FIG. 20B, the thermal head 116 moves to an intermediate position midway between a standby position, illustrated in FIG. 20A, and a printing position, illustrated in FIG. 20C, which forms a nip with the platen roller 115 (step S2102). When the movement of the thermal head 116 is complete, the printer 100 starts sheet feed operations (step S2103). When the sheet feed operations are started, a pressure plate 120 provided in the printer 100 is biased toward a sheet feed roller 121 by a biasing mechanism (not shown), and pushes the recording sheet 113, which has been loaded in the sheet storage unit 117, upward against the sheet feed roller 121. In the standby position illustrated in FIG. 20A, the sheet feed roller 121 is retracted to a position distanced from the recording sheet 113. In the intermediate position illustrated in FIG. 20B, the sheet feed roller 121 is pushed downward, by driving force from the position changing motor 210 (not shown), to a position of contact with the recording sheet 113. At this time, the sheet feed roller 121 is rotated in what is the counter-clockwise direction in the drawings by driving force from the sheet conveying motor 209 (not shown), and conveys the recording sheet 113 toward a printing section which includes the thermal head 116 and the platen roller 115. The recording sheet 113 makes contact with a separating portion 122 of the printer 100, and as a result, only the uppermost sheet of the recording sheet 113 is conveyed. The conveyed recording sheet 113 is detected by the sheet detecting sensors 206, and it is confirmed that there are no problems with the sheet feed operations. Then, the recording sheet 113 conveyed by the sheet feed roller 121 is rotated in what is the clockwise direction in the drawings by pressing upward on a changeover plate 123, which is supported so as to be capable of rotating, and advances in the left direction in the drawings to enter a nip area between a convey roller 124 and a convey slave roller 125. A plurality of minute protrusions which contact the back surface of the recording sheet 113 are formed in the convey roller 124, and can contact the recording sheet 113 so as to accurately convey the recording sheet 113. The convey roller 124 is driven by the sheet conveying motor 20) (not shown). The sheet conveying motor 209 is a stepping motor, which makes it possible to accurately control the feed rate. After the recording sheet 113 is conveyed to the nip area between the convey roller 124 and the convey slave roller 125, the sheet feed roller 121 is moved to the standby position, illustrated in FIG. 20A, by a driving mechanism (not shown). This is to prevent the next recording sheet 113 in the sheet storage unit 117 from being accidentally conveyed by the sheet feed roller 121. The conveyance of the recording sheet 113 by the convey roller 124 and the convey slave roller 125 is continued, and the conveyance is stopped once a trailing edge of the recording sheet 113 has passed the sheet detecting sensors 206, been conveyed by a predetermined amount, and passed a tip portion of the changeover plate 123. Next, the printer 100 conveys the recording sheet 113 backwards in the opposite direction, and stops at a printing start position, illustrated in FIG. 20C (step S2104). At this time, the trailing edge of the recording sheet 113 passes above the changeover plate 123 and below the sheet feed roller 121, and is conveyed to a space between a guide wall 127, which partitions an area below a battery 126 and holds the battery 126, and a sheet storage portion wall 128.

Once the sheet feed operations are complete and the recording sheet 113 stops at the printing start position, operations for cueing the yellow (Y) part of the ink ribbon 114 are performed (step S2105). The ribbon cueing operations will be described hereinafter. Once the recording sheet 113 has been conveyed to the printing start position illustrated in FIG. 20C, the ink ribbon 114 held within the ink cassette 300 is pulled out. In other words, the end part of the winding bobbin 301 of the ink cassette 300 engages with an engagement portion of the printer 100 and is rotated in what is the counterclockwise direction in the drawings by a driving mechanism (not shown), and as a result, the ink ribbon 114 wound upon the supply bobbin 302 is pulled out and wound upon the winding bobbin 301. As illustrated in FIG. 19, the markers 114*a* are provided at the beginning of each color of ink in the ink ribbon 114, and two of the markers 114*a* are provided at the start of the yellow (Y) part. When the ribbon detecting sensor 207, which is a reflective optical sensor, detects that reflected light has been blocked by the marker 114*a* provided in the ink ribbon 114, the printer 100 stops the winding of the ink ribbon 114 and performs the cueing. The cueing of the yellow (Y) part is determined in accordance with whether or not two of the markers 114*a* have been detected (step S2106). If, when cueing the yellow (Y) part, only one marker 114*a* has been detected, or no markers 114*a* have been detected in a predetermined amount of time, it is assumed that the ink cassette 300 has malfunctioned, and a state expressing an error is displayed in the display unit 102 (step S2107). Then, the thermal head 116 is moved to the standby position illustrated in FIG. 20A, and the printing operations end (step S2129).

Once the cueing of the yellow (Y) part is complete, the thermal head 116 is rotated further about the thermal head support shaft 119 in what is the counterclockwise direction in the drawings, and moves to a printing position, in which the ink ribbon 114 and the recording sheet 113 are tightly held between the thermal head 116 and the platen roller 115 (step S2108). Once the thermal head 116 has moved to the printing position, the recording sheet 113 and the ink ribbon 114 remain tightly held between the thermal head 116 and the platen roller 115, as illustrated in FIG. 20D; and in this state, the ink on the ink ribbon 114 is heated by the thermal head 116 and transferred onto the recording sheet 113 while being conveyed toward the discharge port 101C, and an image is printed as a result (step S2109). During the printing, the ink ribbon 114 and the recording sheet 113 are conveyed at the same speed, and thus an ink ribbon convey mechanism of the printer 100 incorporates a torque limiter (described later) which slips when a load greater than or equal to a set torque is produced.

When an image is printed as a result of the heating performed by the thermal head 116, the ink ribbon 114 and the recording sheet 113 are conveyed for a set distance while remaining in a state of close contact, and are then conveyed in directions away from each other. In other words, the recording sheet 113 is conveyed to the left in the drawings by the convey roller 124, and the ink ribbon 114 is conveyed toward the guide shaft 303 of the ink cassette 300 while sliding along a separating plate 129 of the thermal head 116. Although the ink ribbon 114 has adhered to the recording sheet 113 as a result of being heated by the thermal head 116 during printing, the ink ribbon 114 is conveyed to the position of the separating plate 129 and is separated from the recording sheet 113. Once the yellow image region has been printed onto the recording sheet 113, a driving mechanism (not shown) of the printer 100 rotates and retracts the thermal head 116 to the position illustrated in FIG. 20C (step S2110). Then, the recording sheet 113 is conveyed in the direction opposite from that used in the printing operations, to the position illustrated in FIG. 20C, and is moved to the printing start position as a result (step S2111). Thereafter, the ink ribbon 114 is wound and conveyed in the same manner as in the operations for printing the yellow (Y) part, and is conveyed to and stopped at the printing start position by detecting the markers 114*a*, after which a magenta (M) part is printed (steps S2112 to S2115). In the same manner, the cueing is performed by detecting the markers 114*a*, and the cyan (C) and overcoat (OP) parts are printed as well (steps S2116 to S2127). Once the overcoat has been printed, the thermal head 116 is retracted from the recording sheet 113, as illustrated in FIG. 20E; then, the recording sheet 113 is conveyed toward the discharge port 101C, and when the trailing edge of the recording sheet 113 passes the convey roller 124, the discharge is complete (step S2128). Once the discharge is complete, the thermal head 116 is rotated to the standby position, illustrated in FIG. 20A, by the driving mechanism (not shown), and the printing operations end (step S2129).

The sequence described above completes printing operations, in which the inks are layered in the order of yellow (Y), magenta (M), cyan (C), and the overcoat (OP) and are transferred onto the recording sheet 113.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2020-015532 and 2020-015604, filed Jan. 31, 2020 which are hereby incorporated by reference herein in their entirety.

What is claimed is:

1. An ink cassette comprising:

a supply bobbin on which an ink ribbon is wound;

a winding bobbin for winding up the ink ribbon fed from the supply bobbin; and an enclosure including a supply bobbin storage portion that rotatably stores the supply bobbin and a winding bobbin storage portion that rotatably stores the winding bobbin, wherein in each of the supply bobbin storage portion and the winding bobbin storage portion an elastic piece and a rotation restricting portion are provided, the supply bobbin and the winding bobbin are capable of moving in a rotational axis direction, and each has a rotation-restricted portion, the supply bobbin and the winding bobbin are each biased by the elastic pieces in the rotational axis direction of the supply bobbin and the winding bobbin toward the rotation restricting portions, and the rotation-restricted portions engage with the rotation restricting portions and restrict rotation of the supply bobbin and the winding bobbin, wherein in each of the supply bobbin storage portion and the winding bobbin storage portion, an opening is provided in a wall forming one side surface which is one end portion of the enclosure in the rotational axis direction, the elastic piece is provided within the opening and the rotation-restricting portion is provided on an inner side of another side surface of the enclosure, wherein the wall forming the one side surface of the enclosure is substantially orthogonal to rotational axes of the supply bobbin and the winding bobbin, the elastic piece is formed with a bent portion that bends in a direction substantially orthogonal to a direction in which the elastic piece biases the bobbin, wherein the bent portion of the elastic piece bends in the opening within the wall forming the one side surface of the enclosure, and the opening is configured so that a tip portion of the elastic piece contacting the supply bobbin or the winding bobbin enters the opening when the elastic piece elastically deforms in a direction opposite to the rotation restricting portions.

2. The ink cassette according to claim 1, wherein each of the elastic pieces is provided as part of the one side surface of the enclosure.

3. The ink cassette according to claim 1, wherein the bent portion is bent at greater than or equal to 90 degrees.

4. The ink cassette according to claim 1, wherein the elastic pieces bias the supply bobbin and the winding bobbin by contacting corresponding tip ends of the supply bobbin and the winding bobbin on the one side surface side in the rotational axis direction.

5. The ink cassette according to claim 1, wherein the elastic pieces are formed so that tip ends of the elastic pieces that bias the supply bobbin and the winding bobbin are wider than base portions of the elastic pieces.

6. The ink cassette according to claim 1, wherein a projection portion that projects from the side surface is provided in a periphery of each of the openings in the one side surface of the enclosure.

7. The ink cassette according to claim 6, wherein the projection portions are formed so tip ends of the projection portions project beyond positions of the elastic pieces in the rotational axis direction when the supply bobbin and the winding bobbin have moved toward the one side surface of the enclosure.

8. The ink cassette according to claim 1, wherein each of the elastic pieces has an inclined surface inclined toward an interior of the enclosure.

9. The ink cassette according to claim 1, wherein a length of the supply bobbin storage portion and the winding bobbin storage portion in the enclosure in a direction orthogonal to the rotational axis direction is less than or equal to 20 mm.

10. The ink cassette according to claim 1, wherein a width of the openings is less than or equal to 10 mm.

11. The ink cassette according to claim 1, wherein when the ink cassette is mounted in a printer, the rotation-restricted portions disengage from the rotation restricting portions by the supply bobbin and the winding bobbin being moved, by a member of the printer, toward the one side surface of the enclosure in which the elastic pieces are provided.

12. The ink cassette according to claim 1, wherein the elastic piece is aligned with the wall.

13. The ink cassette according to claim 1, wherein the elastic piece is L-shaped.

14. The ink cassette according to claim 1, wherein the elastic piece is integrally formed with the wall forming the one side surface of the enclosure.

15. The ink cassette according to claim 14, wherein the elastic piece has a first portion and a second portion which are adjacent to each other through the bent portion, the first portion is connected to the wall and the second portion is the tip portion of the elastic piece.

16. The ink cassette according to claim 15, wherein the opening is provided around the elastic piece except for a portion in which the elastic piece is connected to the wall.

17. The ink cassette according to claim 1, wherein the elastic piece is smaller than the opening.

18. A printer in which an ink cassette can be mounted and removed, the ink cassette comprising:

a supply bobbin on which an ink ribbon is wound;

a winding bobbin for winding up the ink ribbon fed from the supply bobbin; and an enclosure including a supply bobbin storage portion that rotatably stores the supply bobbin and a winding bobbin storage portion that rotatably stores the winding bobbin, wherein in each of the supply bobbin storage portion and the winding bobbin storage portion an elastic piece and a rotation restricting portion are provided, the supply bobbin and the winding bobbin are capable of moving in a rotational axis direction, and each has a rotation-restricted portion, and the supply bobbin and the winding bobbin are each biased by the elastic pieces in the rotational axis direction of the supply bobbin and the winding bobbin toward the rotation restricting portions, and the rotation-restricted portions engage with the rotation restricting portions and restrict rotation of the supply bobbin and the winding bobbin, wherein in each of the supply bobbin storage portion and the winding bobbin storage portion, an opening is provided in a wall forming one side surface which is one end portion of the enclosure in the rotational axis direction, and the elastic piece is provided within the opening and the rotation-restricting portion is provided on an inner side of another side surface of the enclosure, and wherein the wall forming the one side surface of the enclosure is substantially orthogonal to rotational axes of the supply bobbin and the winding bobbin, the elastic piece is formed with a bent portion that bends in a direction substantially orthogonal to a direction in which the elastic piece biases the bobbin, wherein the bent portion of the elastic piece bends in the opening within the wall forming the one side surface of the enclosure, and the opening is configured so that a tip portion of the elastic piece contacting the supply bobbin or the winding bobbin enters the opening when the elastic piece elastically deforms in a direction opposite to the rotation restricting portions;

the printer comprising:

a member configured to, when the ink cassette is mounted, cause the rotation-restricted portions to disengage from the rotation restricting portions by moving the supply bobbin and the winding bobbin toward the one side surface of the enclosure in which the elastic pieces are provided.

19. An ink cassette comprising a supply bobbin storage portion configured to support a supply bobbin on which an ink sheet to which ink is applied is wound, a winding bobbin storage portion configured to support a winding bobbin that winds up the ink sheet pulled out from the supply bobbin, and a connecting portion that connects the supply bobbin storage portion and the winding bobbin storage portion, the ink cassette capable of being mounted in a printer using an axial direction of the supply bobbin and the winding bobbin as a mounting direction, wherein the connecting portion includes a first connecting portion that connects a near side of the supply bobbin storage portion and the winding bobbin storage portion with respect to the mounting direction, and a second connecting portion that connects a far side of the supply bobbin storage portion and the winding bobbin storage portion with respect to the mounting direction, and wherein the second connecting portion includes:

a first projecting portion that extends along the ink sheet fed from the supply bobbin storage portion toward the winding bobbin storage portion and projects toward the far side in the mounting direction;

a second projecting portion that extends from the first projecting portion to the winding bobbin storage portion, connects to the winding bobbin storage portion, and projects toward the far side in the mounting direction; and a third projecting portion that extends from the first projecting portion to the supply bobbin storage portion, connects to the winding bobbin storage portion, and projects toward the far side in the mounting direction.

20. The ink cassette according to claim 19, wherein the second projecting portion connects to a surface of the winding bobbin storage portion on the far side with respect to the mounting direction, and the third projecting portion connects to a surface of the supply bobbin storage portion on the far side with respect to the mounting direction.

21. The ink cassette according to claim 19, wherein the supply bobbin storage portion includes a feed-side guide wall that guides the ink sheet pulled from the supply bobbin toward the winding bobbin storage portion, and the third projecting portion extends along the feed-side guide wall, and the winding bobbin storage portion includes a winding-side guide wall that guides the ink sheet from the feed-side guide wall toward the winding bobbin storage portion, and the second projecting portion extends along the winding-side guide wall.

22. The ink cassette according to claim 21, further comprising:

a guide shaft configured to bend, toward the winding bobbin, a conveyance path of the ink sheet conveyed along the winding-side guide wall, wherein a rib is provided in a portion connecting the first projecting portion and the third projecting portion, the rib being substantially triangular, the third projecting portion is connected along an end part of a surface of the supply bobbin storage portion on the far side in the mounting direction, the end part being located on a side where the third projecting portion is located, the second projecting portion extends to a position covering a bearing portion of the guide shaft provided in the winding bobbin storage portion, and the second projecting portion is connected along an end part of a surface of the winding bobbin storage portion on the far side in the mounting direction, the end part being located on a side where the second projecting portion is located.

23. The ink cassette according to claim 19, wherein a print head of the printer is located in a region enclosed within the supply bobbin storage portion, the winding bobbin storage portion, the first connecting portion, and the second connecting portion.

24. The ink cassette according to claim 19, wherein the first connecting portion is a planar plate member that connects the supply bobbin storage portion and the winding bobbin storage portion.

25. The ink cassette according to claim 19, wherein the second connecting portion is formed in a substantially U shape when the ink cassette is viewed from the far side in the mounting direction.

26. The ink cassette according to claim 19, wherein the printer includes a raising/lowering mechanism that raises and lowers a print head, when the ink cassette is mounted, part of the raising/lowering mechanism is disposed in a position facing a part that is a side part of the third projecting portion and an end part of the supply bobbin storage portion, and when the ink cassette is mounted, part of the raising/lowering mechanism is disposed above the first projecting portion.

* * * * *